US012433428B2

(12) United States Patent
Ewing et al.

(10) Patent No.: US 12,433,428 B2
(45) Date of Patent: Oct. 7, 2025

(54) ANTI-SWEEPING HOOK WITH INTEGRATED INVENTORY MONITORING AND/OR LOSS PREVENTION FUNCTIONALITY

(71) Applicant: Fasteners for Retail, Inc., Twinsburg, OH (US)

(72) Inventors: Brent O. Ewing, Roscoe, IL (US); Chan Chor Man, Hong Kong (HK); Yun Hua, Solon, OH (US); Jeffrey A. Comstock, Edgerton, WI (US)

(73) Assignee: Fasteners for Retail, Inc., Twinsburg, OH (US)

( * ) Notice: Subject to any disclaimer, the term of this patent is extended or adjusted under 35 U.S.C. 154(b) by 474 days.

(21) Appl. No.: 17/887,655

(22) Filed: Aug. 15, 2022

(65) Prior Publication Data

US 2023/0059326 A1 Feb. 23, 2023

Related U.S. Application Data

(60) Provisional application No. 63/236,097, filed on Aug. 23, 2021.

(51) Int. Cl.
*A47F 1/12* (2006.01)
*A47F 5/08* (2006.01)

(52) U.S. Cl.
CPC ..... *A47F 1/128* (2013.01); *A47F 5/0861* (2013.01)

(58) Field of Classification Search
CPC ... A47F 1/128; A47F 5/0861; A47F 2010/025
See application file for complete search history.

(56) References Cited

U.S. PATENT DOCUMENTS 1,922,989 A 8/1933 Terry
2,358,658 A 9/1944 Riche et al.
2,398,411 A 4/1946 Cook
(Continued)

FOREIGN PATENT DOCUMENTS

CN 102124178 A 7/2011
CN 102763184 A 10/2012
(Continued)

OTHER PUBLICATIONS

U.S. Appl. No. 18/305,022, Ewing et al., filed Apr. 21, 2023.
U.S. Appl. No. 18/106,233, Ewing et al., filed Feb. 6, 2023.
U.S. Appl. No. 18/114,012, Ewing et al., filed Feb. 24, 2023.

*Primary Examiner* — Stanton L Krycinski
(74) *Attorney, Agent, or Firm* — Reinhart Boerner Van Deuren P.C.

(57) ABSTRACT

An anti-sweeping hook includes a display hook, a helical coil, and a rotating handle. The display hook may be substantially straight and has a first end and a second end opposite the first end. The helical coil is disposed about the display hook and extends along a lengthwise portion of the display hook. The helical coil has a first coil end proximate the first end of the display hook. Rotation of the helical coil in a first direction loads the retail merchandise onto the display hook. Rotation of the helical coil in a second direction opposite the first direction removes the retail merchandise from the display hook. The rotating handle is configured to determine a change in an amount of stored inventory based on the amount and direction of rotation of the rotating handle.

16 Claims, 18 Drawing Sheets

(56) References Cited

U.S. PATENT DOCUMENTS

| | | | |
|---|---|---|---|
| 2,954,128 | A | 9/1960 | Gordon |
| 2,996,593 | A | 8/1961 | McMains |
| 3,248,005 | A | 4/1966 | Joschko |
| 3,550,121 | A | 12/1970 | Porter, Jr. |
| 3,572,546 | A | 3/1971 | Schlaf |
| 3,706,309 | A | 12/1972 | Toftness |
| 3,773,217 | A | 11/1973 | Schlaf |
| 3,848,745 | A | 11/1974 | Smith |
| 3,852,735 | A | 12/1974 | Matsuda et al. |
| 3,983,341 | A | 9/1976 | Stanish |
| 4,001,805 | A | 1/1977 | Golbe |
| 4,020,305 | A | 4/1977 | Schwartz |
| 4,021,796 | A | 5/1977 | Fawcett, Jr. et al. |
| 4,122,437 | A | 10/1978 | Petersen |
| 4,166,273 | A | 8/1979 | Riley, Jr. et al. |
| 4,227,188 | A | 10/1980 | Petersen |
| 4,269,025 | A | 5/1981 | Kondo |
| 4,289,242 | A | 9/1981 | Kenyon |
| 4,311,889 | A | 1/1982 | Blanchard et al. |
| 4,312,460 | A | 1/1982 | Boettcher |
| 4,352,170 | A | 9/1982 | Jetter |
| 4,352,171 | A | 9/1982 | Jetter |
| 4,370,069 | A | 1/1983 | Nomura |
| 4,383,242 | A | 5/1983 | Sassover et al. |
| 4,384,906 | A | 5/1983 | Molinari et al. |
| 4,462,023 | A | 7/1984 | Nielsen et al. |
| 4,470,236 | A | 9/1984 | MacDonald, Jr. |
| 4,475,658 | A | 10/1984 | Roberts |
| 4,566,598 | A | 1/1986 | Fors |
| 4,600,119 | A | 7/1986 | Olson |
| 4,638,922 | A | 1/1987 | Stoltz |
| 4,675,654 | A | 6/1987 | Copeland |
| 4,706,821 | A | 11/1987 | Kohls et al. |
| 4,712,694 | A | 12/1987 | Breslow |
| 4,718,626 | A | 1/1988 | Thalenfeld et al. |
| 4,742,923 | A | 5/1988 | Calvert |
| 4,821,894 | A | 4/1989 | Dechirot |
| D300,994 | S | 5/1989 | Wolff |
| 4,830,201 | A | 5/1989 | Breslow |
| 4,836,390 | A | 6/1989 | Polvere |
| 4,870,228 | A | 9/1989 | Speer et al. |
| 4,887,737 | A | 12/1989 | Adenau |
| 4,899,668 | A | 2/1990 | Valiulis |
| 4,901,869 | A | 2/1990 | Hawkinson et al. |
| 4,942,386 | A | 7/1990 | Willis |
| 4,944,414 | A | 7/1990 | Albright |
| 4,962,367 | A | 10/1990 | Tymn |
| 4,967,044 | A | 10/1990 | Speer et al. |
| 4,996,515 | A | 2/1991 | Schaffer et al. |
| 5,009,334 | A | 4/1991 | Bodkins |
| 5,068,643 | A | 11/1991 | Yashina |
| 5,070,986 | A | 12/1991 | Hoffman et al. |
| 5,083,638 | A | 1/1992 | Schneider |
| 5,086,641 | A | 2/1992 | Roselli |
| 5,114,021 | A | 5/1992 | Fredrickson |
| 5,161,704 | A | 11/1992 | Valiulis |
| 5,168,263 | A | 12/1992 | Drucker |
| 5,222,608 | A | 6/1993 | Eklof et al. |
| 5,240,126 | A | 8/1993 | Foster et al. |
| 5,255,182 | A | 10/1993 | Adams |
| 5,265,738 | A | 11/1993 | Yablans et al. |
| 5,307,941 | A | 5/1994 | Siegal |
| 5,317,304 | A | 5/1994 | Choi |
| 5,335,892 | A | 8/1994 | Busch |
| 5,397,856 | A | 3/1995 | Lee |
| 5,434,559 | A | 7/1995 | Smiley et al. |
| 5,469,135 | A | 11/1995 | Solow |
| 5,570,080 | A | 10/1996 | Inoue et al. |
| 5,610,337 | A | 3/1997 | Nelson |
| 5,641,077 | A | 6/1997 | Tufano et al. |
| 5,649,641 | A | 7/1997 | Campoli |
| 5,671,851 | A | 9/1997 | Johnson et al. |
| 5,685,664 | A | 11/1997 | Parham et al. |
| 5,690,238 | A | 11/1997 | Schmehr |
| 5,730,320 | A | 3/1998 | David |
| 5,748,082 | A | 5/1998 | Payne |
| 5,757,270 | A | 5/1998 | Mori |
| 5,815,066 | A | 9/1998 | Pumilia |
| 5,838,225 | A | 11/1998 | Todd |
| 5,839,588 | A | 11/1998 | Hawkinson |
| 5,855,282 | A | 1/1999 | Hardy |
| 5,905,438 | A | 5/1999 | Weiss et al. |
| 5,906,283 | A | 5/1999 | Kump et al. |
| 5,955,951 | A | 9/1999 | Wischerop et al. |
| 5,965,954 | A | 10/1999 | Johnson et al. |
| 5,971,173 | A | 10/1999 | Valiulis et al. |
| 5,977,654 | A | 11/1999 | Johnson et al. |
| 5,979,674 | A | 11/1999 | Thalenfeld |
| 5,995,003 | A | 11/1999 | Rogers |
| 6,041,720 | A | 3/2000 | Hardy |
| 6,049,268 | A | 4/2000 | Flick |
| 6,082,558 | A | 7/2000 | Battaglia |
| 6,102,192 | A | 8/2000 | Tomuro et al. |
| 6,105,791 | A | 8/2000 | Chalson et al. |
| 6,109,458 | A | 8/2000 | Walsh et al. |
| 6,129,218 | A | 10/2000 | Henry et al. |
| 6,131,748 | A | 10/2000 | Kawasaki et al. |
| 6,133,830 | A | 10/2000 | D'Angelo et al. |
| 6,158,598 | A | 12/2000 | Josefsson |
| 6,269,285 | B1 | 7/2001 | Mignault |
| 6,279,256 | B1 | 8/2001 | Norolof et al. |
| 6,286,690 | B1 | 9/2001 | Thalenfeld |
| 6,373,381 | B2 | 4/2002 | Wu |
| 6,409,028 | B2 | 6/2002 | Nickerson |
| 6,418,797 | B1 | 7/2002 | Ambrosina et al. |
| 6,474,478 | B1 | 11/2002 | Huehner et al. |
| 6,517,000 | B1 | 2/2003 | McAllister et al. |
| D472,331 | S | 3/2003 | Zadak |
| 6,539,280 | B1 | 3/2003 | Valiulis et al. |
| 6,628,344 | B1 | 9/2003 | Weber |
| D480,231 | S | 10/2003 | Valiulis et al. |
| 6,659,291 | B2 | 12/2003 | Huehner et al. |
| 6,690,411 | B2 | 2/2004 | Naidoo et al. |
| 6,769,552 | B1 | 8/2004 | Thalenfeld |
| 6,820,754 | B2 | 11/2004 | Ondrasik |
| 6,824,009 | B2 | 11/2004 | Hardy |
| 6,874,684 | B1 | 4/2005 | Denenberg et al. |
| 6,886,699 | B2 | 5/2005 | Johnson et al. |
| 6,889,854 | B2 | 5/2005 | Burke |
| 6,923,330 | B1 | 8/2005 | Nagel |
| 6,964,235 | B2 | 11/2005 | Hardy |
| 6,967,578 | B1 | 11/2005 | Guida |
| 7,007,810 | B2 | 3/2006 | Huehner et al. |
| 7,017,778 | B2 | 3/2006 | Halbherr |
| 7,018,180 | B2 | 3/2006 | Koo |
| 7,059,518 | B2 | 6/2006 | Forster |
| 7,137,513 | B2 | 11/2006 | Sedon et al. |
| 7,174,176 | B1 | 2/2007 | Liu |
| 7,178,678 | B2 | 2/2007 | Mansfield et al. |
| 7,202,784 | B1 | 4/2007 | Herwig |
| 7,210,164 | B1 | 4/2007 | Jandrell |
| 7,258,461 | B1 | 8/2007 | Izardel |
| 7,287,669 | B2 | 10/2007 | Takeda |
| 7,293,663 | B2 | 11/2007 | Lavery, Jr. |
| 7,347,335 | B2 | 3/2008 | Rankin, VI et al. |
| 7,377,402 | B2 | 5/2008 | Takeda |
| 7,395,938 | B2 | 7/2008 | Merit et al. |
| 7,530,188 | B2 | 5/2009 | Beilenhoff et al. |
| 7,533,784 | B2 | 5/2009 | Vlastakis et al. |
| 7,559,437 | B2 | 7/2009 | Colelli et al. |
| 7,566,037 | B2 | 7/2009 | Vogler |
| 7,584,930 | B2 | 9/2009 | Zich |
| 7,591,422 | B2 | 9/2009 | Maitin |
| 7,591,442 | B2 | 9/2009 | Dinh et al. |
| 7,671,741 | B2 | 3/2010 | Lax et al. |
| 7,671,742 | B2 | 3/2010 | Fallin et al. |
| 7,749,121 | B2 | 7/2010 | Perng |
| 7,768,399 | B2 | 8/2010 | Hachmann et al. |
| 7,792,711 | B2 | 9/2010 | Swafford, Jr. et al. |
| 7,828,158 | B2 | 11/2010 | Colelli et al. |
| 7,905,364 | B2 | 3/2011 | Pail |
| 7,916,020 | B2 | 3/2011 | Seidel |
| 7,969,305 | B2 | 6/2011 | Belden, Jr. et al. |
| 8,016,128 | B2 | 9/2011 | Valiulis et al. |

(56) References Cited

U.S. PATENT DOCUMENTS 8,069,994 B2 12/2011 Barkdoll
8,103,047 B1 1/2012 Griess et al.
8,139,945 B1 3/2012 Amir et al.
8,190,289 B2 5/2012 Lockwood et al.
8,240,486 B2 8/2012 Niederhuefner et al.
8,260,456 B2 9/2012 Siegel et al.
8,274,391 B2 9/2012 Yang
8,276,766 B2 10/2012 Rataiczak, III et al.
8,328,027 B2 12/2012 Barkdoll
8,360,253 B2 1/2013 Hardy
8,368,542 B2 2/2013 Yang
8,373,564 B2 2/2013 Wyatt, Jr. et al.
8,378,826 B2 2/2013 Mercier et al.
8,386,075 B2 2/2013 Lockwood et al.
8,443,988 B2 5/2013 Niederhuefner
8,523,012 B2 * 9/2013 Richardson ..... A47F 5/0861 70/57.1
8,534,469 B2 9/2013 Northrup, Jr. et al.
8,629,772 B2 1/2014 Valiulis et al.
8,684,227 B2 * 4/2014 Richardson ..... A47F 5/0823 70/57.1
8,720,702 B2 5/2014 Nagel
8,803,687 B2 8/2014 Valiulis et al.
8,812,378 B2 8/2014 Swafford, Jr. et al.
8,823,521 B2 9/2014 Overhultz et al.
8,884,761 B2 11/2014 Valiulis
8,941,495 B2 1/2015 Wiese et al.
9,009,773 B1 4/2015 Hendricks et al.
9,129,494 B2 9/2015 Valiulis et al.
9,167,916 B2 10/2015 Grant et al.
9,241,583 B2 1/2016 Nagel
9,254,049 B2 2/2016 Nagel
9,318,007 B2 4/2016 Valiulis et al.
9,318,008 B2 4/2016 Valiulis et al.
9,324,220 B2 4/2016 Valiulis
9,437,736 B2 9/2016 Taniguchi et al.
9,483,896 B2 11/2016 Lockwood et al.
9,495,856 B2 11/2016 Brenner
9,576,417 B2 2/2017 Christianson
9,675,184 B2 * 6/2017 Xin ..... A47F 1/128
9,805,334 B2 10/2017 Overhultz et al.
9,805,539 B2 10/2017 Swafford, Jr. et al.
9,818,081 B2 11/2017 Khalid et al.
10,111,540 B2 * 10/2018 Brej ..... A47F 1/128
10,121,341 B2 11/2018 Ewing et al.
10,219,636 B2 * 3/2019 Berglund ..... A47F 5/0861
10,271,666 B2 4/2019 Taylor et al.
10,357,118 B2 7/2019 Swafford
10,535,216 B2 1/2020 Swafford, Jr. et al.
10,720,035 B2 7/2020 Ewing et al.
10,885,753 B2 1/2021 Ewing et al.
10,993,550 B2 5/2021 Ewing et al.
11,006,768 B2 * 5/2021 Berglund ..... A47F 5/0869
11,154,143 B2 10/2021 Ewing et al.
11,154,144 B2 * 10/2021 Bird ..... A47F 1/128
11,317,738 B2 5/2022 Ewing et al.
11,363,894 B2 6/2022 Ewing et al.
11,403,906 B2 * 8/2022 Hua ..... A47F 5/0823
11,412,863 B2 8/2022 Grant et al.
11,605,276 B2 3/2023 Ewing et al.
2001/0002210 A1 5/2001 Petite
2001/0004239 A1 6/2001 Irizarry et al.
2001/0044751 A1 11/2001 Pugliese, III et al.
2002/0004690 A1 1/2002 Paulucci et al.
2002/0067259 A1 6/2002 Fufidio et al.
2002/0108916 A1 8/2002 Nickerson
2002/0130776 A1 9/2002 Houde
2002/0188866 A1 12/2002 Jalaludeen et al.
2003/0004784 A1 1/2003 Li et al.
2003/0029816 A1 2/2003 Huehner et al.
2003/0030548 A1 2/2003 Kovacs et al.
2003/0057167 A1 3/2003 Johnson et al.
2003/0175004 A1 9/2003 Garito et al.
2003/0227382 A1 12/2003 Breed
2004/0034581 A1 2/2004 Hill et al.
2004/0053044 A1 3/2004 Moreno et al.
2004/0073334 A1 4/2004 Terranova
2004/0084386 A1 5/2004 Huehner et al.
2004/0124201 A1 7/2004 Hieb
2004/0145477 A1 7/2004 Easter et al.
2004/0195319 A1 10/2004 Forster
2005/0029283 A1 2/2005 Pedigo
2005/0040123 A1 2/2005 Ali
2005/0056602 A1 3/2005 Hardy
2005/0098626 A1 5/2005 Jordan et al.
2005/0104733 A1 5/2005 Campero
2005/0161420 A1 7/2005 Hardy et al.
2005/0168345 A1 8/2005 Swafford et al.
2005/0189309 A1 9/2005 Hardy
2005/0189369 A1 9/2005 Vlastakis et al.
2005/0261816 A1 11/2005 DiCroce et al.
2005/0279722 A1 12/2005 Ali
2005/0288708 A1 12/2005 Kammerer et al.
2006/0049122 A1 3/2006 Mueller et al.
2006/0068144 A1 3/2006 Mizuno et al.
2006/0163180 A1 7/2006 Rankin, VI et al.
2006/0163272 A1 7/2006 Gamble
2006/0198611 A1 9/2006 Park
2006/0219517 A1 10/2006 Cheng et al.
2006/0226095 A1 10/2006 Hardy
2006/0240398 A1 10/2006 Hardy et al.
2007/0050271 A1 3/2007 Ufford et al.
2007/0080123 A1 4/2007 Mason
2007/0080806 A1 4/2007 Lax et al.
2007/0095903 A1 5/2007 Suenbuel
2007/0108142 A1 5/2007 Medcalf et al.
2007/0115100 A1 5/2007 Mandie
2007/0171059 A1 7/2007 Pistilli
2007/0251900 A1 11/2007 Hardy
2007/0265866 A1 11/2007 Fehling
2007/0267364 A1 11/2007 Barkdoll
2007/0267367 A1 11/2007 Mueller et al.
2007/0273513 A1 11/2007 White
2008/0015956 A1 1/2008 Regard
2008/0203253 A1 8/2008 Vogler
2008/0307687 A1 12/2008 Nagel et al.
2008/0309489 A1 12/2008 Hachmann et al.
2009/0006196 A1 1/2009 Barkan et al.
2009/0079557 A1 3/2009 Miner
2009/0091448 A1 4/2009 Leyden et al.
2009/0095695 A1 4/2009 Moock et al.
2009/0101606 A1 4/2009 Olson
2009/0109027 A1 4/2009 Schuller
2009/0174566 A1 7/2009 Volk et al.
2009/0248198 A1 10/2009 Siegel et al.
2009/0308494 A1 12/2009 Linn
2010/0012602 A1 1/2010 Valiulis et al.
2010/0013603 A1 1/2010 Chatani et al.
2010/0097223 A1 4/2010 Kruest et al.
2010/0175438 A1 7/2010 Sankey
2010/0200526 A1 8/2010 Barkdoll
2010/0237093 A1 9/2010 Lockwood et al.
2010/0238031 A1 9/2010 Belden, Jr. et al.
2010/0268792 A1 10/2010 Butler et al.
2011/0055103 A1 3/2011 Swafford, Jr. et al.
2011/0062794 A1 3/2011 Vergoossen et al.
2011/0068921 A1 3/2011 Shafer
2011/0094975 A1 4/2011 Hardy
2011/0127225 A1 6/2011 Hooks, Jr. et al.
2011/0168652 A1 7/2011 Barkdoll
2011/0215060 A1 9/2011 Niederhuefner
2011/0218889 A1 9/2011 Westberg et al.
2011/0227735 A1 9/2011 Fawcett et al.
2011/0282768 A1 11/2011 Swafford, Jr. et al.
2011/0284571 A1 11/2011 Lockwood et al.
2011/0310307 A1 12/2011 Takahashi
2012/0006764 A1 1/2012 Hachmann et al.
2012/0091162 A1 4/2012 Overhultz et al.
2012/0120571 A1 5/2012 Bisesti et al.
2012/0209426 A1 8/2012 Lockwood et al.
2012/0253508 A1 10/2012 Holmes
2012/0287090 A1 11/2012 Cacioppo
2012/0293330 A1 11/2012 Grant et al.
2013/0002422 A1 1/2013 Wiese et al.

(56) References Cited

U.S. PATENT DOCUMENTS

| | | | | |
|---|---|---|---|---|
| 2013/0024023 | A1 | 1/2013 | Siegel et al. | |
| 2013/0057524 | A1 | 3/2013 | Bertin et al. | |
| 2013/0106259 | A1 | 5/2013 | Lockwood et al. | |
| 2013/0141240 | A1 | 6/2013 | Valiulis et al. | |
| 2013/0142494 | A1 | 6/2013 | Valiulis et al. | |
| 2013/0144433 | A1 | 6/2013 | Lockwood et al. | |
| 2013/0247834 | A1 | 9/2013 | Kodat | |
| 2013/0312644 | A1 | 11/2013 | Copeland | |
| 2014/0055264 | A1 | 2/2014 | Valiulis et al. | |
| 2014/0055266 | A1 | 2/2014 | Valiulis | |
| 2014/0070948 | A1 | 3/2014 | Valiulis et al. | |
| 2014/0197953 | A1 | 7/2014 | Valiulis et al. | |
| 2014/0352372 | A1 | 12/2014 | Grant et al. | |
| 2015/0042178 | A1 | 2/2015 | Kim | |
| 2015/0068991 | A1 | 3/2015 | Kostka | |
| 2015/0096998 | A1 | 4/2015 | Bird et al. | |
| 2015/0235501 | A1* | 8/2015 | Wang | G07F 17/3297 221/262 |
| 2015/0238026 | A1 | 8/2015 | Chambers | |
| 2015/0321827 | A1 | 11/2015 | Lockwood et al. | |
| 2015/0371482 | A1 | 12/2015 | Szpak et al. | |
| 2016/0005282 | A1 | 1/2016 | Lax et al. | |
| 2016/0132822 | A1 | 5/2016 | Swafford | |
| 2017/0202369 | A1 | 7/2017 | Mercier et al. | |
| 2017/0303704 | A1 | 10/2017 | Taylor et al. | |
| 2018/0047243 | A1 | 2/2018 | Swafford, Jr. et al. | |
| 2018/0107973 | A1 | 4/2018 | Overhultz et al. | |
| 2018/0365953 | A1 | 12/2018 | Ewing et al. | |
| 2019/0019140 | A1 | 1/2019 | Costello et al. | |
| 2019/0183259 | A1 | 6/2019 | Grant et al. | |
| 2019/0272498 | A1 | 9/2019 | Swafford | |
| 2019/0275498 | A1 | 9/2019 | Tanba et al. | |
| 2019/0290020 | A1 | 9/2019 | Ewing et al. | |
| 2019/0374048 | A1 | 12/2019 | Valiulis et al. | |
| 2021/0001785 | A1 | 1/2021 | Rose | |
| 2021/0093100 | A1 | 4/2021 | Ewing et al. | |
| 2022/0000278 | A1 | 1/2022 | Ewing et al. | |
| 2022/0202207 | A1 | 6/2022 | Ewing et al. | |
| 2022/0240693 | A1 | 8/2022 | Ewing et al. | |
| 2023/0059326 | A1 | 2/2023 | Ewing et al. | |

FOREIGN PATENT DOCUMENTS

| | | | |
|---|---|---|---|
| CN | 103158757 | A | 6/2013 |
| CN | 103198387 | A | 7/2013 |
| CN | 204039597 | U | 12/2014 |
| CN | 104631970 | A | 5/2015 |
| CN | 204351457 | U | 5/2015 |
| CN | 104981825 | A | 10/2015 |
| CN | 107462171 | A | 12/2017 |
| CN | 107529899 | A | 1/2018 |
| CN | 108694540 | A | 10/2018 |
| CN | 207943567 | U | 10/2018 |
| EP | 2988281 | A1 | 2/2016 |

* cited by examiner

ANTI-SWEEPING HOOK WITH INTEGRATED INVENTORY MONITORING AND/OR LOSS PREVENTION FUNCTIONALITY

CROSS-REFERENCE TO RELATED PATENT APPLICATIONS

This patent application claims the benefit of U.S. Provisional Patent Application No. 63/236,097, filed Aug. 23, 2021, the entire teachings and disclosure of which are incorporated herein by reference thereto.

FIELD OF THE INVENTION

This invention generally relates to retail merchandise displays, and more particularly to the management of inventory of retail merchandise of a retail merchandise displays.

BACKGROUND OF THE INVENTION

In certain retail environments that use conventional wire hook displays, one disadvantage is that a large number of items can often be easily swept or removed from the wire hook display at any one time, through a simple sliding action. As a result, thieves have been able to enter a commercial environment and simply remove all items from a conventional wire hook in a simple sliding motion and abscond without drawing attention to their actions.

Consequently, there is a need to provide a device that provides many of the advantages of the conventional wire hook display device while also providing a deterrent against theft of items stored on the display device.

Further yet, monitoring of inventory on a wire hook is desirable. Remote monitoring or automatic monitoring of the inventory is additionally desirable.

Embodiments of the present invention provides such a device. These and other advantages of the invention, as well as additional inventive features, will be apparent from the description of the invention provided herein.

BRIEF SUMMARY OF THE INVENTION

In one aspect, embodiments of the invention provide an anti-sweeping hook that includes a display hook for storing retail merchandise. The display hook is substantially straight and having a first end and a second end opposite the first end. A helical coil is disposed about the display hook and extending along a lengthwise portion of the display hook. The helical coil has a first coil end proximate the first end of the display hook. Rotation of the helical coil in a first direction loads the retail merchandise onto the display hook. Rotation of the helical coil in a second direction opposite the first direction removes the retail merchandise from the display hook. A rotating handle is attached to the first end of the display hook and to the first coil end. The rotating handle is configured to determine an extent of rotation for the rotating handle.

In a particular embodiment, the rotating handle includes a first contact and a second contact disposed within a main housing of the rotating handle such that an electrical connection between the first and second contacts indicates some rotation of the rotating handle. In a more particular embodiment, the rotating handle includes a rotor and stator each disposed within the main housing of the rotating handle. The first contact is attached to the main housing, and the second contact is attached to the rotor. The rotor and stator are configured such that rotation of the rotor in a first direction prevents any electrical connection between the first and second contacts, and rotation of the rotor in a second direction opposite the first direction facilitates electrical connections between the first and second contacts.

In certain embodiments, the stator is configured to prevent rotation of the stator and of the second contact in the first direction, and configured to allow rotation of the stator and of the second contact in the second direction. The rotating handle may include a circuit board with circuitry configured to count the electrical connections between the first and second contacts. In some embodiments, the circuitry includes an MCU configured to trigger an alarm if a threshold number of electrical connections between the first and second contacts occurs within a predetermined time period.

The alarm may be one of an audio alarm, a visual alarm, and a wired or wireless signal transmitted to a local or remotely-located receiving device. In particular embodiments, the MCU enters a sleep mode if there is no electrical connection between the first and second contacts for the predetermined time period. In other embodiments, the MCU provides one of an audio indicator, a visual indicator, and a wired or wireless indicator signal transmitted to a local or remotely-located receiving device prior to entering sleep mode.

In another aspect, embodiments of the invention provide a rotating handle for an anti-sweeping retail display hook. The rotating handle includes a first contact and a second contact disposed within a main housing of the rotating handle such that an electrical connection between the first and second contacts indicates some rotation of the rotating handle. A rotor and stator are each disposed within the main housing of the rotating handle. The first contact is attached to the main housing, and the second contact is attached to the rotor. The rotor and stator are configured such that rotation of the rotor in a first direction prevents any electrical connection between the first and second contacts, and rotation of the rotor in a second direction opposite the first direction facilitates electrical connections between the first and second contacts.

In some embodiments, the stator is configured to prevent rotation of the stator and of the second contact in the first direction, and configured to allow rotation of the stator and of the second contact in the second direction. In other embodiments, the rotating handle includes a circuit board with circuitry configured to count the electrical connections between the first and second contacts. The circuitry may include an MCU configured to trigger an alarm if a threshold number of electrical connections between the first and second contacts occurs within a predetermined time period. The alarm may be one of an audio alarm, a visual alarm, and a wired or wireless signal transmitted to a local or remotely-located receiving device.

In particular embodiments, the MCU enters a sleep mode if there is no electrical connection between the first and second contacts for the predetermined time period. In a further embodiment, the MCU provides an audio indicator, a visual indicator, and a wired or wireless indicator signal transmitted to a local or remotely-located receiving device prior to entering sleep mode.

In one embodiment, an anti-sweeping hook including a display hook, a helical coil, and a rotating handle is provided. The display hook stores retail merchandise. The display hook may be substantially straight and has a first end and a second end opposite the first end. The helical coil is disposed about the display hook and extends along a lengthwise portion of the display hook. The helical coil has a first coil end proximate the first end of the display hook. Rotation of the helical coil in a first direction loads the retail merchandise onto the display hook. Rotation of the helical coil in a second direction opposite the first direction removes the retail merchandise from the display hook. The rotating handle is attached to the first end of the display hook and to the first coil end, wherein the rotating handle is configured to determine a change in an amount of stored inventory based on the amount and direction of rotation of the rotating handle.

In one embodiment, the rotating handle includes a first circuit and a second circuit. A state change of the first circuit without a state change in the second circuit indicates rotation of the rotating handle in a first direction and a state change of both the first and second circuits indicates rotation of the rotating handle in a second direction, opposite the first.

In one embodiment, the rotating handle includes a rotor and stator each disposed within a main housing of the rotating handle. The rotor rotates relative to the stator with the main housing when the main housing rotates in a first direction and the rotor remains fixed relative to the stator when the main housing is rotated in a second direction. The first circuit includes a first contact carried by the stator and a pair of contacts carried by the main housing. The second circuit includes a second contact carried by the rotor and a pair of contacts carried by the main housing. Rotating the main housing in the first direction causes the first contact to selectively connect and disconnect the pair of contacts of the first circuit carried by the main housing but does not cause the second contact to selectively connect and disconnect the pair of contacts of the second circuit carried by the main housing. Rotating the main housing in the second direction causes the first contact to selectively connect and disconnect the pair of contacts of the first circuit carried by the main housing and does cause the second contact to selectively connect and disconnect the pair of contacts of the second circuit carried by the main housing.

In one embodiment, the stator is configured to prevent rotation of the rotor and of the second contact in the second direction and configured to allow rotation of the rotor and of the second contact in the first direction.

In one embodiment, the rotating handle includes a circuit board with circuitry configured to count the electrical connections between the first contact and the pair of contacts carried by the rotating handle of the first circuit and to count the electrical connections between the second contact and the pair of contacts carried by the rotating handle of the second circuit.

In one embodiment, the rotating handle includes a wireless communications module configured to transmit inventory data related to the amount of product stored on the display hook or a change in the amount to a local or remotely-located receiving device.

In one embodiment, the circuit board is configured to determine an amount of stored inventory or a change in the amount of stored inventory based on a number of electrical connections made by the first and second circuits.

In one embodiment, the circuit board is configured to determine the change in the amount of stored inventory based on a number of electrical connections made by the first and second circuits.

In one embodiment, the stator is fixed relative to the display hook.

In an embodiment, a method of determining a change in an amount of stored inventory on an anti-sweeping hook is provided. The method includes rotating a rotating handle of the anti-sweeping hook. The anti-sweeping hook includes a display hook configured for storing retail merchandise. The display hook has a first end and a second end opposite the first end. The anti-sweeping hook includes a helical coil disposed about the display hook and extending along a lengthwise portion of the display hook. The helical coil has a first coil end proximate the first end of the display hook. Rotation of the helical coil in a first direction loads the retail merchandise onto the display hook, and rotation of the helical coil in a second direction opposite the first direction removes the retail merchandise from the display hook. The rotating handle is attached to the first end of the display hook and to the first coil end. The method includes determining a change in the amount of stored inventory by determining the amount of rotation of the rotating handle and direction of rotation of the rotating handle.

In one embodiment, determining the direction of rotation of the rotating handle includes determining that the direction of rotation is in a first direction when a state change of a first circuit of the rotating handle without sensing a state change of a second circuit is sensed. The method also includes determining that the direction of rotation is in a second direction, opposite the first, when a state change of both the first and second circuits is sensed.

In one embodiment, the first circuit includes a first contact carried by the stator and a pair of contacts carried by the main housing. The second circuit includes a second contact carried by the rotor and a pair of contacts carried by the main housing. The method includes rotating a main housing of the rotating handle in a first direction. Rotation of the main housing in the first direction rotates a rotor of the rotating handle relative to a stator of the rotating handle. Rotation of the main housing in the first direction causes the first contact to selectively connect and disconnect the pair of contacts of the first circuit carried by the main housing but does not cause the second contact to selectively connect and disconnect the pair of contacts of the second circuit carried by the main housing. When rotating a main housing of the rotating handle in a second direction, the rotor remains fixed relative to the stator when the main housing is rotated in the second direction. Rotation of the main housing in the second direction causes the first contact to selectively connect and disconnect the pair of contacts of the first circuit carried by the main housing and does cause the second contact to selectively connect and disconnect the pair of contacts of the second circuit carried by the main housing.

In one embodiment, the method includes preventing, with the stator, rotation of the rotor and of the second contact in the second direction. The method includes allowing, with the stator, rotation of the rotor and of the second contact in the first direction.

In one embodiment, the method includes counting, with a circuit board of the rotating handle, the electrical connections between the first contact and the pair of contacts carried by the rotating handle of the first circuit. The method includes counting, with the circuit board, the electrical connections between the second contact and the pair of contacts carried by the rotating handle of the second circuit.

In one embodiment, the circuit board is configured to determine a change in the amount of stored inventory based on a number of electrical connections made by the first and second circuits.

In one embodiment, the circuit board is configured to determine an amount of stored inventory based on the change in the amount of stored inventory based on the number of electrical connections made by the first and second circuits.

In one embodiment, the stator is fixed relative to the display hook.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
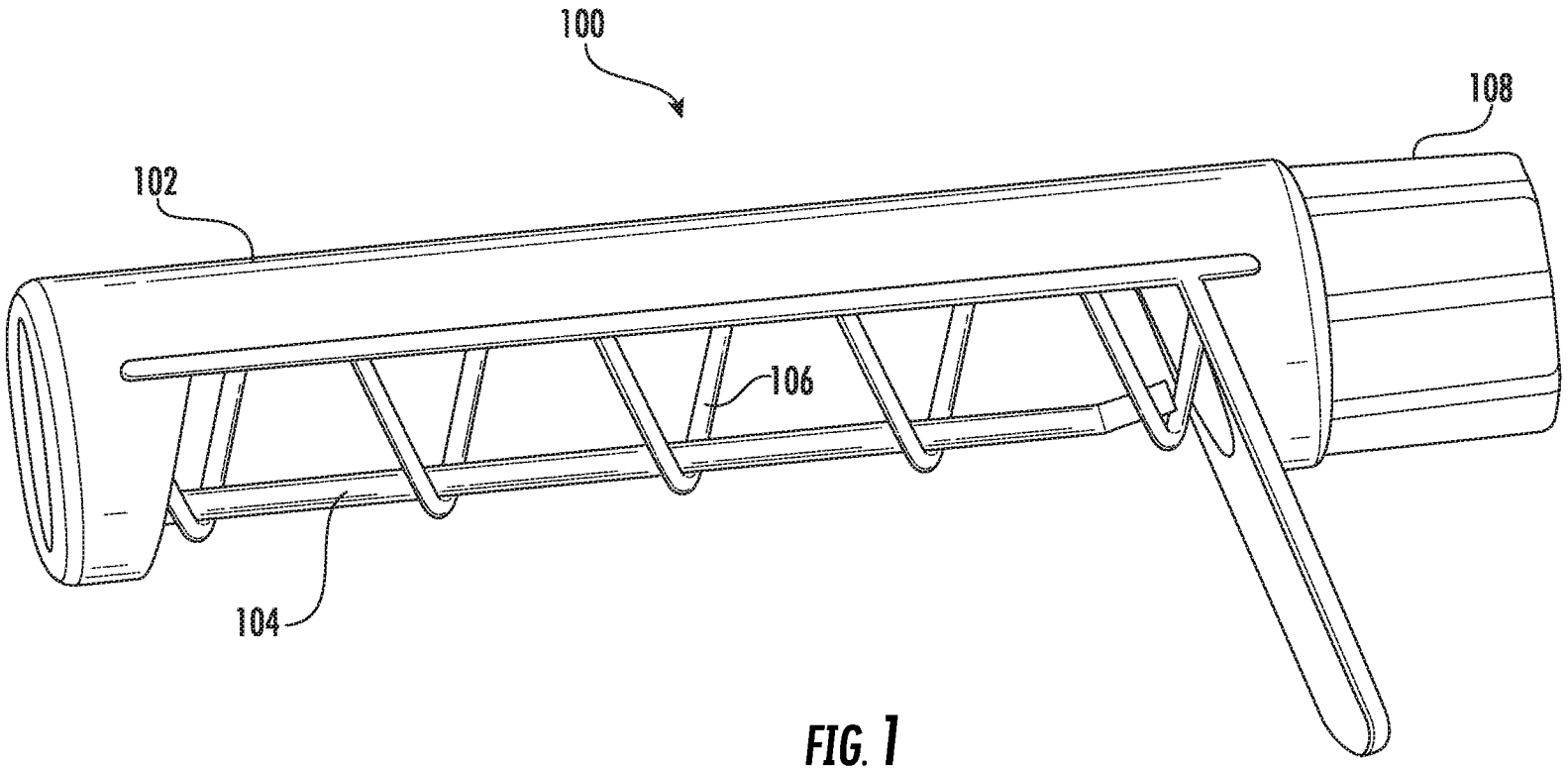
FIG. 1 is a perspective view of an anti-sweeping hook with integrated loss prevention functionality, constructed in accordance with an embodiment of the invention.

FIG. 1 is a perspective view of an anti-sweeping hook 100 with integrated inventory monitoring and/or loss prevention functionality, constructed in accordance with an embodiment of the application. The anti-sweeping hook 100 includes a housing 102 in which is disposed a display hook 104 and a helical coil 106 which is used in the loading and unloading of merchandise stored on the display hook 104. In the embodiment of FIG. 1, the display hook 104 is substantially straight. The display hook 104 may be bend or curved at one end. The coil 106 is coupled to a rotating handle 108, which rotates the coil 106 as it is turned. For example, the rotating handle 108 may be rotated in a clockwise direction when loading merchandise onto the display hook 104. The coil 106 would operate to move the merchandise onto the display hook 104 away from the user or customer. Accordingly, rotating the rotating handle 108 in a counterclockwise direction would operate to remove the merchandise from the display hook 104. It should be recognized that, in other embodiments, the direction of rotation for the rotating handle 108 could be clockwise for removing merchandise and counterclockwise for loading merchandise.

Figure 2:
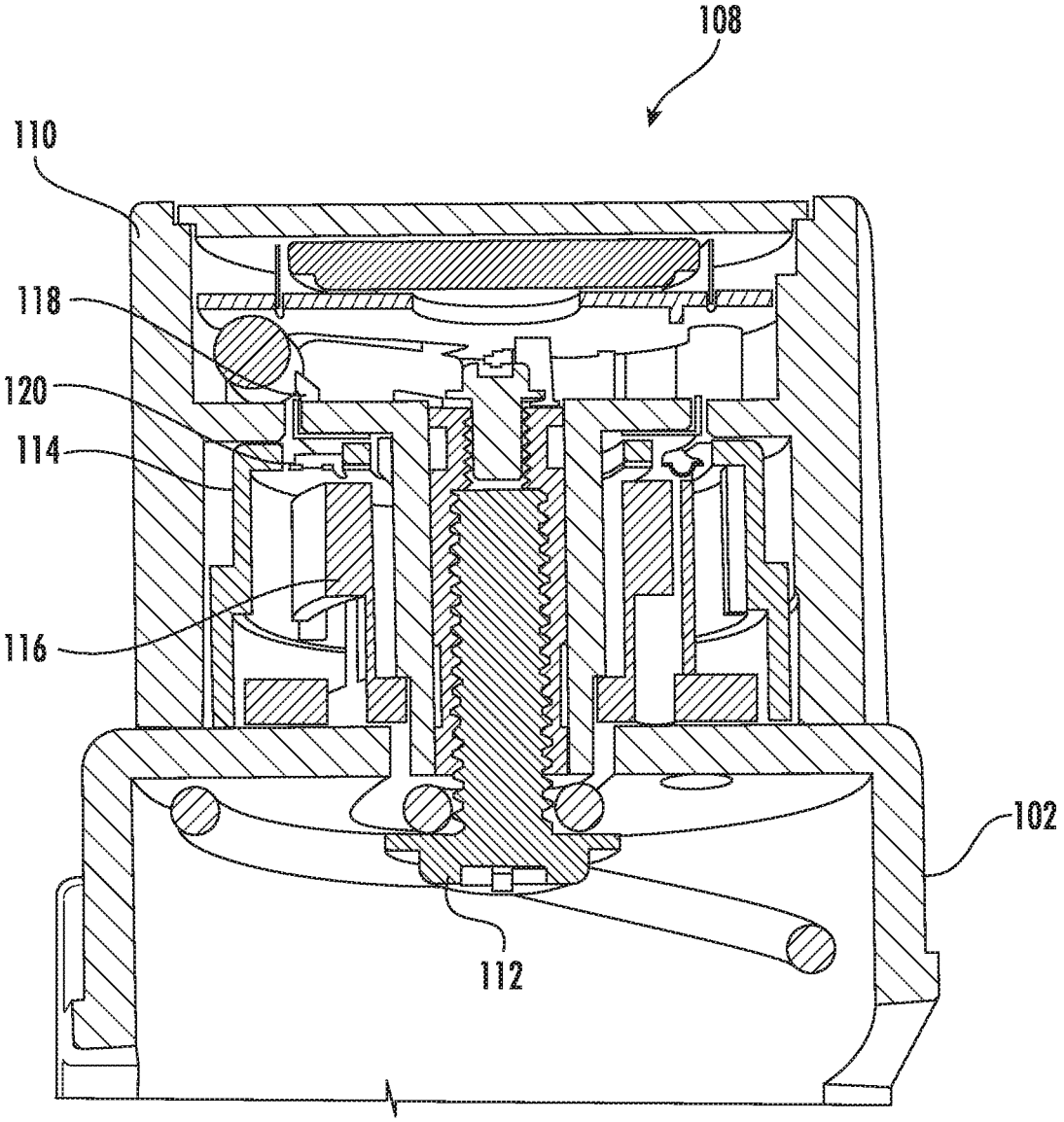
FIG. 2 is a cross-sectional view of a rotating handle for the anti-sweeping hook, constructed in accordance with an embodiment of the invention.

To prevent sweeping, or theft, of all of the products on the display hook 104, the rotating handle 108 includes components designed to monitor the removal of merchandise from the display hook 104. FIG. 2 shows a cross-sectional view of the rotating handle 108, constructed in accordance with an embodiment of the application. In the embodiment of FIG. 2, the rotating handle 108 has a main rotating handle housing 110 and a central fastener 112 which connects the rotating handle 108 to the coil 106 disposed within housing 102.

Figure 3:
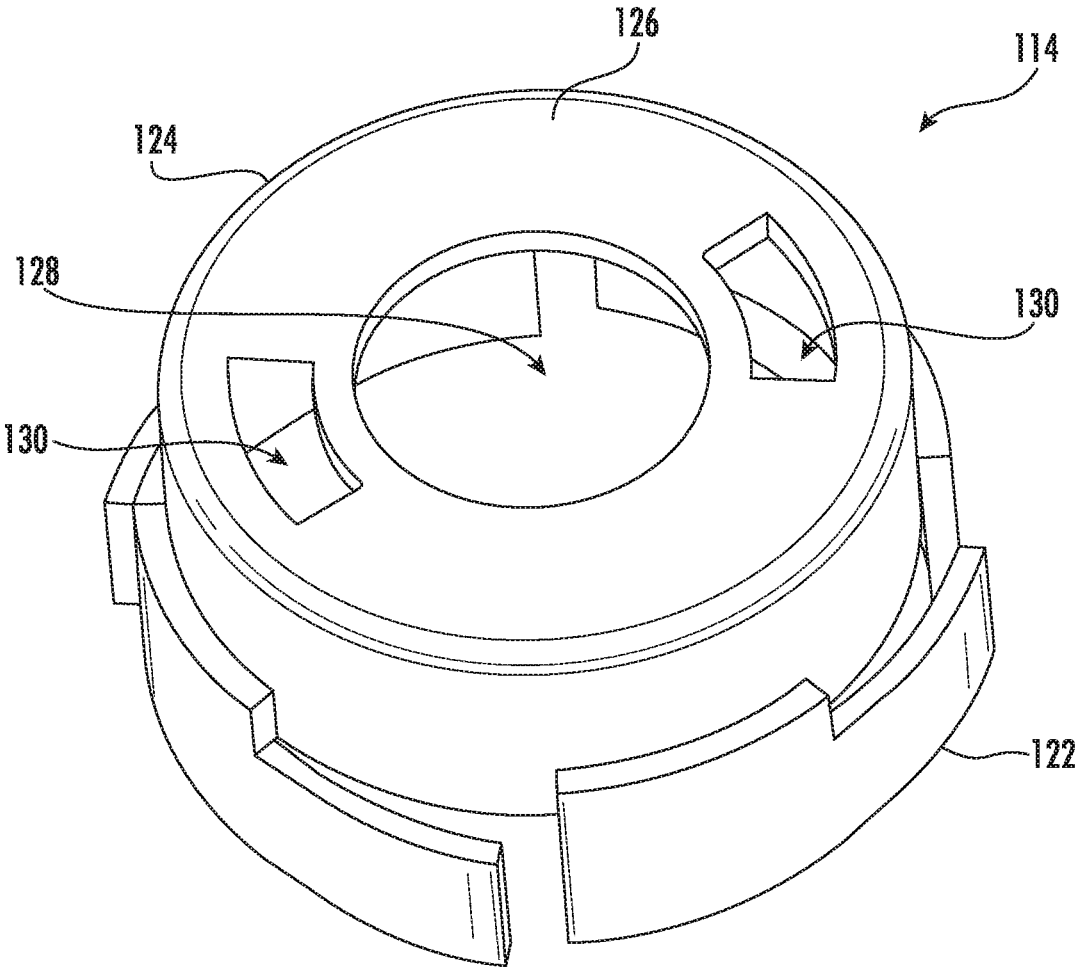
FIG. 3 is a perspective view of a rotor used in the rotating handle for the anti-sweeping hook, constructed in accordance with an embodiment of the invention.
Figure 4:
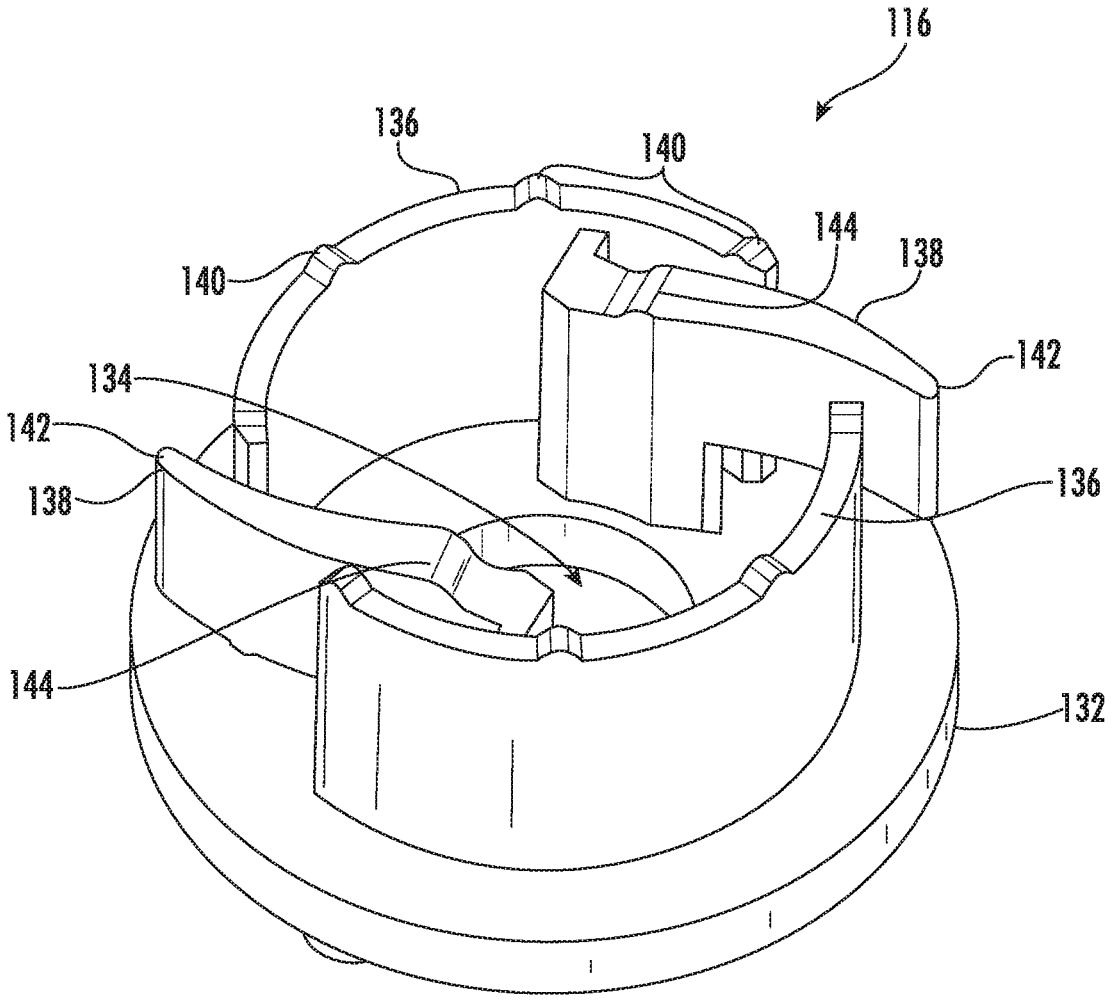
FIG. 4 is a perspective view of a stator used in the rotating handle for the anti-sweeping hook, constructed in accordance with an embodiment of the invention.

The main rotating handle housing 110 houses a rotor 114, which is shown in more detail in the perspective view of FIG. 3, and a stator 116, which is shown in more detail in FIG. 4. The main rotating handle housing 110 also houses a first contact 118, also shown and described below in relation to FIG. 5. A second contact 120 is disposed within the main rotating handle housing 110 and shown in more detail in FIG. 6.

As shown in the embodiment of FIG. 2, the first contact 118 is secured to the main rotating handle housing 110, while the second contact 120 is secured to the rotor 114. In FIG. 2, the stator 116 is positioned below and within the rotor 114.

The embodiment of the rotor 114, shown in the perspective view of FIG. 3, includes a lower perimeter wall 122, which includes notches and openings to facilitate attachment to an interior wall of the main rotating handle housing 110. An upper portion 124 of the rotor 114 includes a top surface 126 with a central opening 128 and two arcuate openings 130 located on opposite sides of the central opening 128. The central opening 128 accommodates the aforementioned central fastener 112, which, in the embodiment of FIG. 2, is positioned along a central portion of the main rotating handle housing 110. As will be explained below, the two arcuate openings 130 allow for electrical contact between the first contact 118 and the second contact 120.

That electrical contact is facilitated by the interaction between the rotor 114 and the stator 116. FIG. 4 is a perspective view of the stator 116 according to an embodiment of the invention. The embodiment of the stator 116 shown in FIG. 4 includes a base 132 with a base central opening 134. On opposite sides of the base central opening 134, there are two curved walls 136. There are two gaps on opposite sides of the base central opening 134 between the two curved walls 136, and, in those gaps, there are two sloped barriers 138. Each of the two curved walls 136 has a plurality of raised portions 140. In the embodiment shown, each of the two curved walls 136 has four raised portions 140, though it is envisioned that alternate embodiments of the stator 116 may have curved walls 136 with a greater or lesser number of raised portions. The sloped barriers 138 have a low end 142 and a high end 144 which slopes upward from the low end 142.

Figure 5:
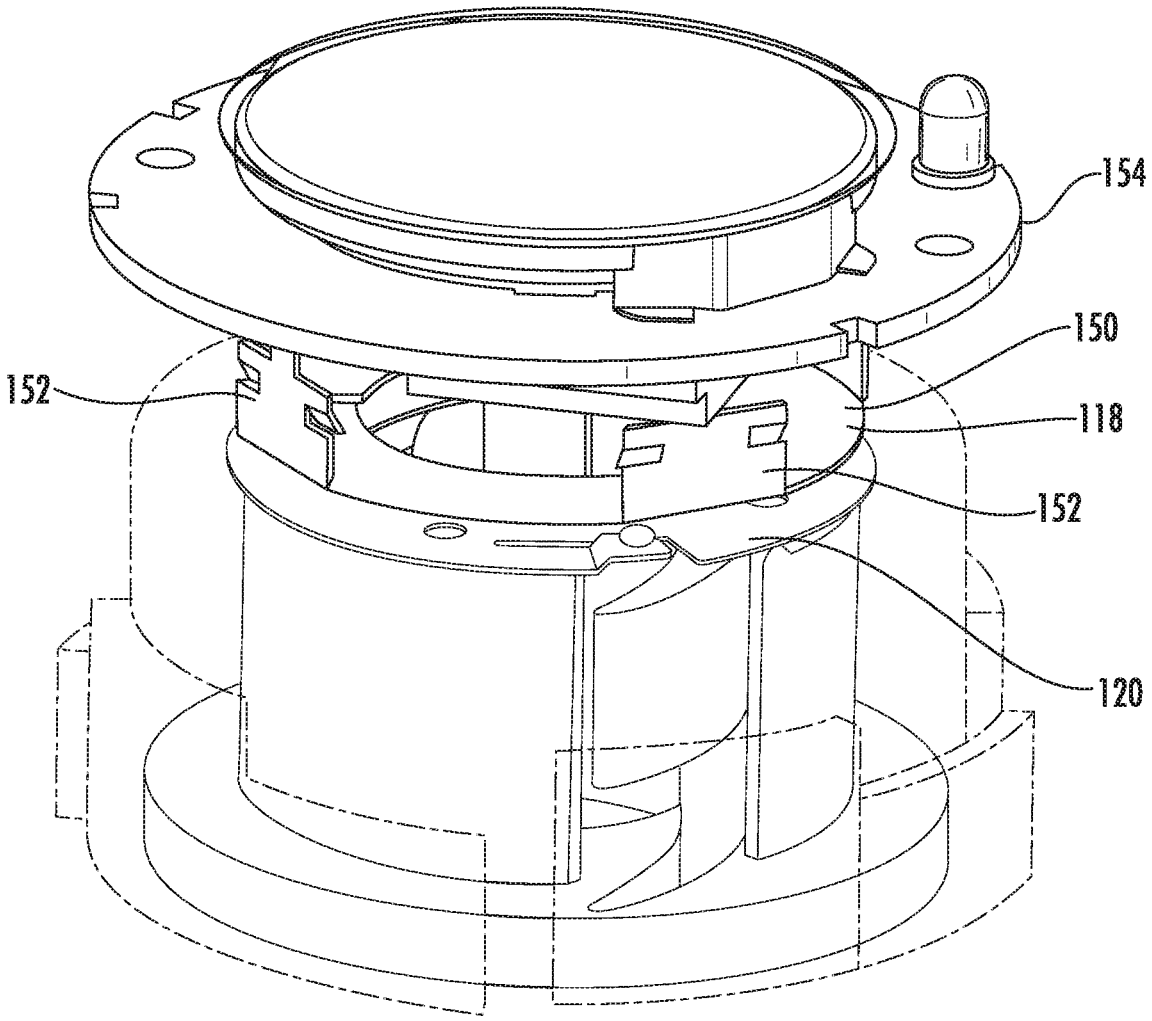
FIG. 5 is a perspective view a portion of the rotating handle, according to an embodiment of the invention.

FIG. 5 is a perspective view a portion of the rotating handle 108, according to an embodiment of the invention, which shows the first and second contacts 118, 120. In the embodiment shown, the first contact 118 has a flat ring-shaped portion and a plurality of tabs 152 to provide electrical connection with a circuit board 154.

Figure 6:
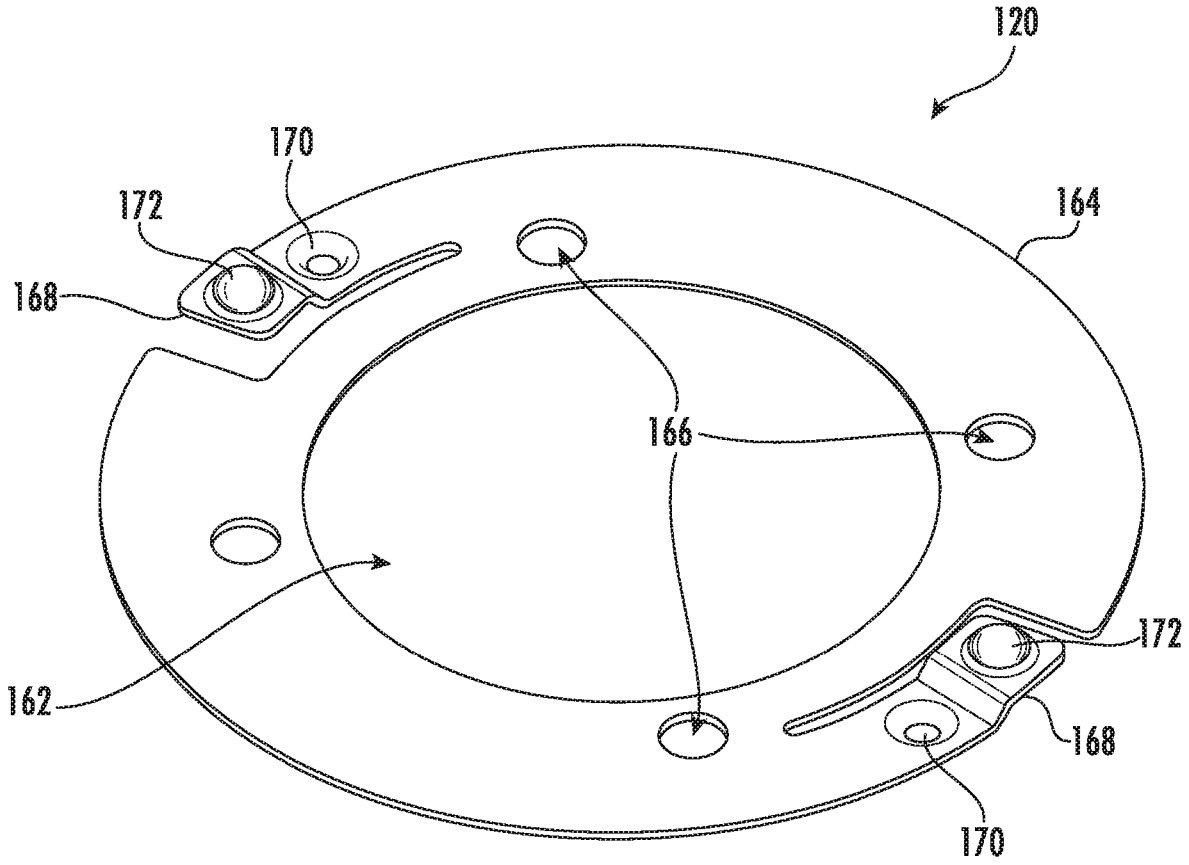
FIG. 6 is a perspective view of the second contact in accordance with an embodiment of the invention.

FIG. 6 is a perspective view of the second contact 120 in accordance with an embodiment of the invention. In the embodiment of FIG. 6, the second contact 120 has a main opening 162 surrounded by a ring-like body 164 which has a plurality of small openings 166 to facilitate attachment of the second contact 120 to the rotor 114. The ring-like body 164 includes two contact fingers 168 located on opposite sides of the main opening 162. Each contact finger 168 has a downward-facing bump 170 and an upward-facing bump 172. The two contact fingers 168 are configured to move relative to the ring-like body 164.

Referring to FIGS. 2-6, the anti-sweeping hook 100 can be described in operation. As shown in FIG. 2, the first contact 118 is attached to an interior surface of the main rotating handle housing 110 in close proximity to the rotor 114, which, as described above, is attached to a different interior surface of the main rotating handle housing 110. The stator 116 is positioned within the rotor 114 such that the two curved walls 136 and the plurality of raised portions 140 thereon are aligned with the two arcuate openings 130 of the rotor 114.

The sloped barriers 138 on the stator 116 are designed such that they prevent rotation of the rotor 114 in one direction. More particularly, when the rotating handle 108, and more particularly the main rotating handle housing 110, is rotated in a first direction, the high ends 144 of the two sloped barriers 138 come into contact with the rotor 114 at the two arcuate openings 130 to prevent the rotor 114 from rotating with the main rotating handle housing 110. Rotation of the main rotating handle housing 110 in this first direction is for loading merchandise onto the display hook 104.

When the rotating handle 108 and the main rotating handle housing 110 are rotated in a second direction opposite the first direction, the two arcuate openings 130 first contact the low end 142 of the two sloped barriers 138 such that the rotor 114 is not prevented from rotating with the main rotating handle housing 110. As the main rotating handle housing 110 is rotating in this second direction, the rotor 114 and attached second contact 120 are rotating as well. This causes the two fingers 168 on the second contact 120 to rise and fall as the downward-facing bumps 170 come into contact with the a plurality of raised portions 140 on the two curved walls 136 of the stator 116. When the two fingers 168 rise due to this contact with the raised portions 140, the two upward-facing bumps 172 of the second contact 120 come into contact with the first contact 118 attached to the main rotating handle housing 110. The resulting electrical connection between the first and second contacts 118, 120 is detected by circuitry on the circuit board 154. Rotation of the main rotating handle housing 110 in this second direction is for removing merchandise from the display hook 104. Thus, with the stator 116, as shown, having four raised portions 140 on each curved wall 136, there would be eight electrical connections between the first and second contacts 118, 120 for each rotation of the rotating handle 108 in the second direction.

Figure 7:
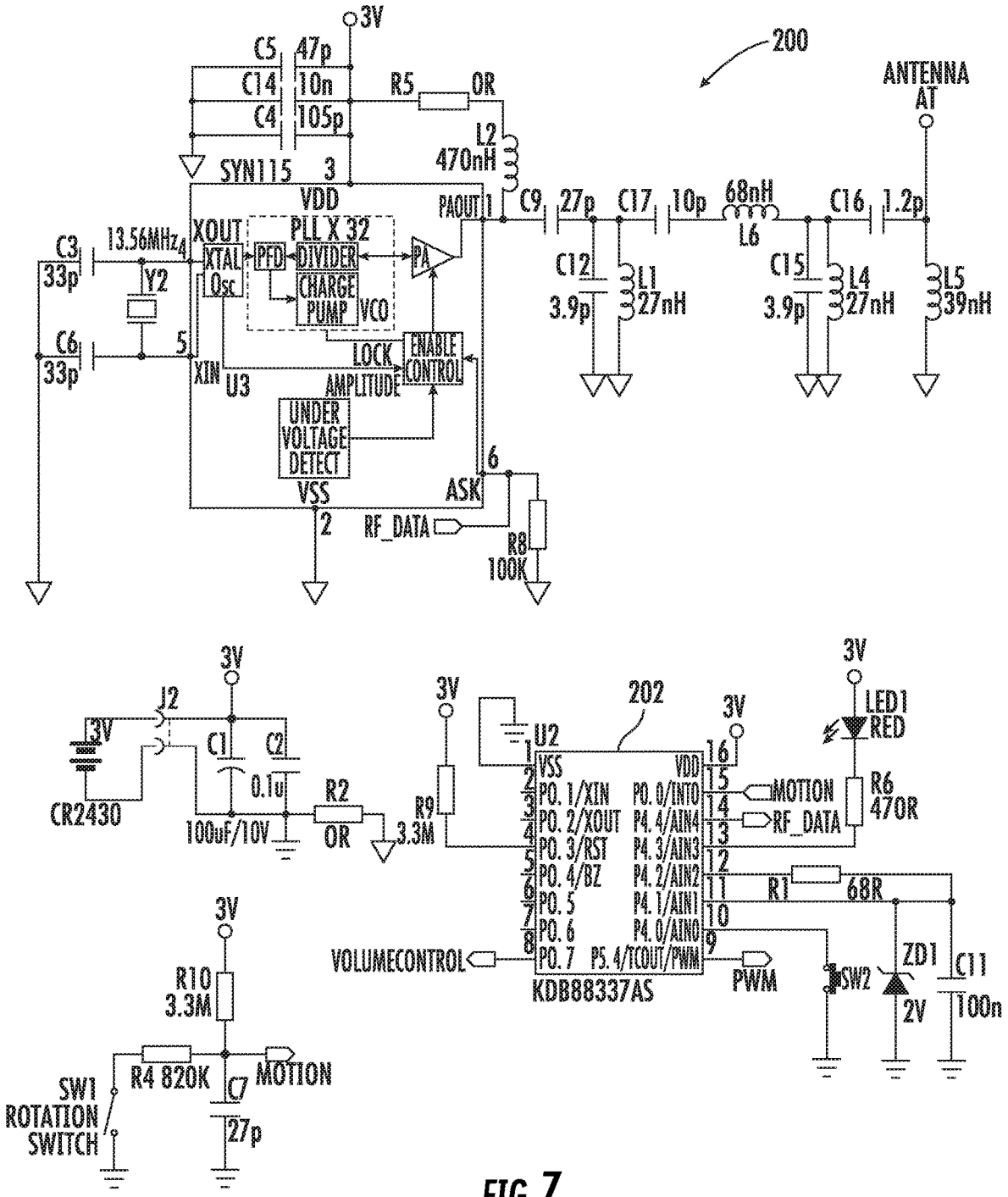
FIG. 7 is a schematic diagram for an exemplary circuit which is included on a circuit board shown in FIG. 5, in accordance with an embodiment of the invention.

FIG. 7 shows a schematic diagram for an exemplary circuit 200, which is included on the circuit board 154 shown in FIG. 5. In one example, when power is supplied to the product, port P5.4 emits an audio signal, such as a beep. A visual signal, such as an LED may flash synchronously at port P4.3, then a microcontroller unit (MCU) 202 enters sleep mode in which the MCU 202 conserves energy.

When the rotating handle 108 is rotated, the MCU 202 wakes up from sleep mode. In such an instance, MCU port P0.0 detects the trigger signal (rotation handle rotates), and counts pulses, or the electrical connections between first and second contacts 118, 120 generated by each rotation of the rotating handle 108. The MCU 202 outputs an audio, visual, or radio signal according to the following conditions. For example, if the number of accumulated electrical connections or pulses in a predetermined time period (e.g., 10 seconds) exceeds a threshold value (e.g., 24, which for the embodiments shown indicates three full rotations of the rotating handle 108), the MCU 202 outputs an audio, visual, wired or wireless alarm signal. The alarm signal, which indicates that three or more items have been removed from the display hook 104 in a short period of time, which may indicate a theft in progress. In another example, the number of pulses generated by each rotation operation, during the predetermined time period, is greater than one but less than 24, MCU 202 outputs an audio, visual or radio signal indicative of a non-theft condition or that the MCU 202 is entering sleep mode. If there are no pulses for a predetermined period of time (e.g., 0.6 seconds at Port P0.0), the MCU 202 determines that the current rotating operation of the rotating handle 108 has been completed.

In a particular embodiment, the visual indicator is an LED, where the LED flashes synchronously with the audio signal when an alarm is triggered, or flashes synchronously with no audio alarm. The MCU 202 may also cause the LED flash to flash in a specific pattern, possibly in concert with an audio signal, to signal a low voltage warning.

Figure 8:
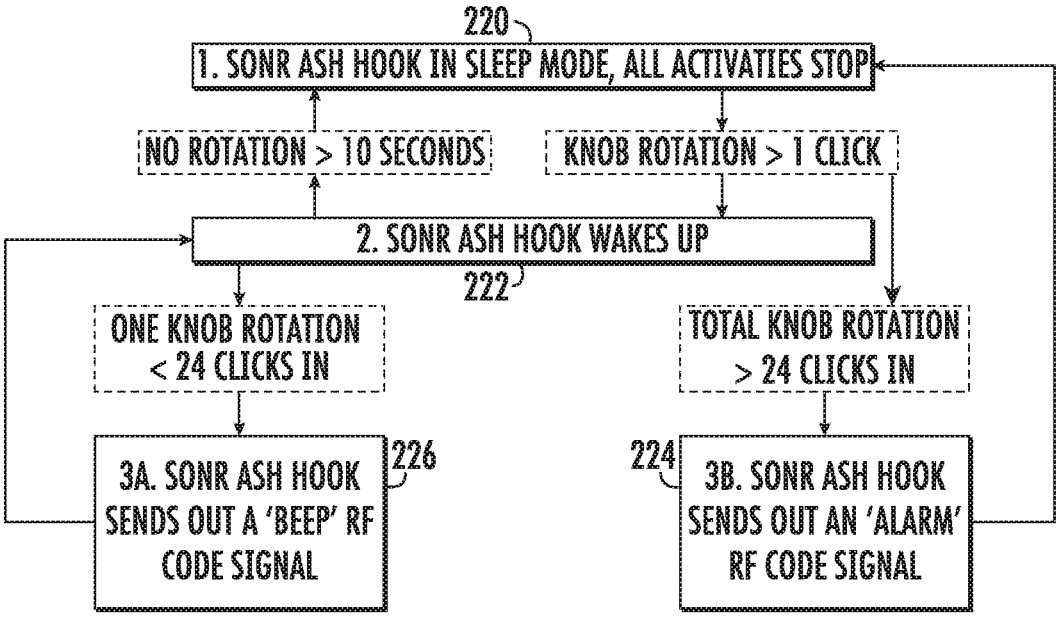
FIG. 8 is a block diagram showing how the circuit of FIG. 7 functions in an exemplary operation of the anti-sweeping hook.

FIG. 8 is a block diagram showing how the circuit 200 of FIG. 7 functions in an exemplary operation of the anti-sweeping hook 100. In the example of FIG. 8, the MCU 202 in circuit 200 starts off in sleep mode in which there is no activity 220. Rotation of the rotating handle 108, such there is at least one electrical connection between the first and second contacts 118, 120, causes the MCU 202 to wake up 222. If the number of electrical connection between the first and second contacts 118, 120 is below some threshold value for a predetermined period of time, the MCU 202 goes back into sleep mode.

In the diagram of FIG. 8, the threshold number of electrical connection between the first and second contacts 118, 120 is 24, and the predetermined period of time is 10 seconds. However, these values may be increased and/or decreased in alternate embodiments of the invention. If the number of electrical connection between the first and second contacts 118, 120 exceeds the threshold value within the predetermined period of time, the MCU 202 triggers an alarm 224. The alarm may take a variety of forms, including but not limited to an audio alarm, a visual alarm via an LED or other lighting means, a wired or wireless signal, such as an RF signal sent to a local or remotely-located receiving device. If the number of electrical connection between the first and second contacts 118, 120 is less than the threshold value, before going into sleep mode the MCU 202 may send an audio signal, such as a beep, or flash the LED, or send a wired or wireless signal to indicate that the MCU 202 is going into sleep mode 226.

Figure 9:
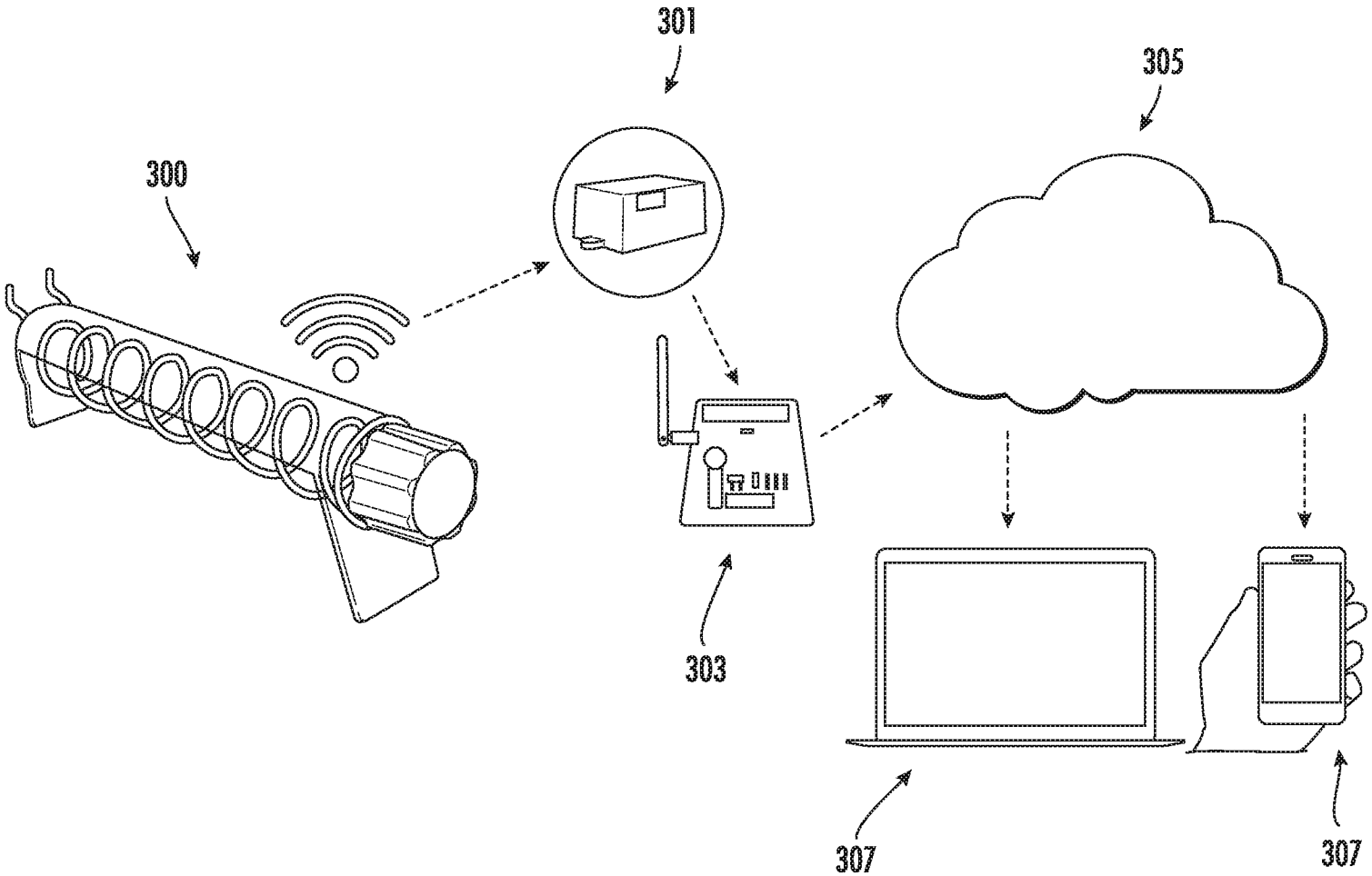
FIG. 9 is a schematic system in which status information of an anti-sweeping hook can be transmitted to a user.

In addition to providing the loss prevention benefits of the anti-sweeping hook 100 described above, some anti-sweeping hooks, such as anti-sweeping hook 300 (also referred to herein as "hook 300") of the system of FIG. 9 can also provide inventory management capabilities. More particularly, the anti-sweeping hook 300 can be used to provide inventory information as to the amount of product that is being stored on the hook 300. In addition to current status of inventory, warnings or other signals related to low stock levels can be sent. The status information can be sent wirelessly, by wire or a combination thereof. The status information can be sent to local devices or remote devices. The status information can be sent via the cloud. Devices such as tablets, computers, handheld smart phones, etc. can be used to access the status information and to receive warning information.

As illustrated in FIG. 9, the hook 300 communicates with an alarm box 301, wirelessly or via a wire. The alarm box 301 can communicate with various devices 307 such as a computer, tablet, phone, or other display device. Further, and as illustrated in FIG. 9, the alarm box 301 can communicate with an internet gateway such as modem 303. Again, this communication can be wired or wireless. In this example, the modem 303 can communicate through the internet 305 to a device 307 such as a computer, tablet phone or other display device so as to communicate inventory information to a user.

Typically, the alarm box 301 is on site or local to the hook 300. Further, while a single hook 300 is illustrated, the alarm box 301 can communicate with a plurality of hooks 300.

The alarm box 301 can receive inventory loss issues such as discussed with regard to hook 100 previously and/or inventory management information such as from hook 300.

Figure 10:
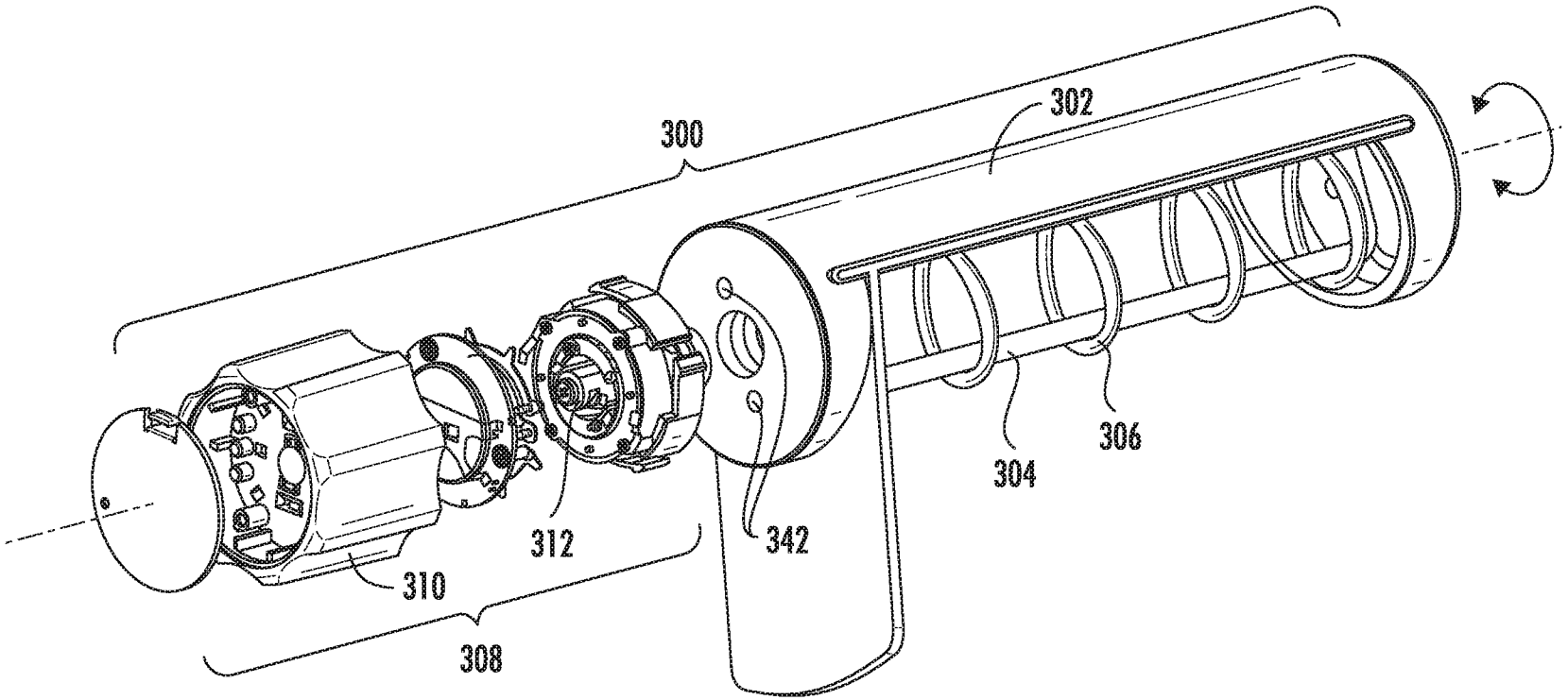
FIG. 10 is a partially exploded perspective view of an anti-sweeping hook with integrated inventory management functionality, constructed in accordance with an embodiment of the invention.

Hook 300 is similar in many respects to hook 100. With reference to FIG. 10, hook 300 includes a housing 302, a display hook 304, a helical coil 306 and a rotating handle 308. The coil 306 is rotatable relative to housing 302 and hook 304 rotate coil 306 to load or unload product from hook 304. Loading occurs when rotating the handle 308 in one direction and then unloading occurs when rotating the handle 308 in the opposite direction. The housing, hook 304 and coil 306 are substantially identical as in hook 100.

The rotating handle 308 has internal electronic componentry that is different than that of rotating handle 108. The electronic componentry may provide to prevent sweeping, or theft, of the productions on the display hook as discussed above. However, the electronic componentry also provides the ability to track and communicate inventory information.

The handle 308 includes a main rotating handle housing 310 that is connected to the coil 306 by a central fastener 312.

Figure 11:
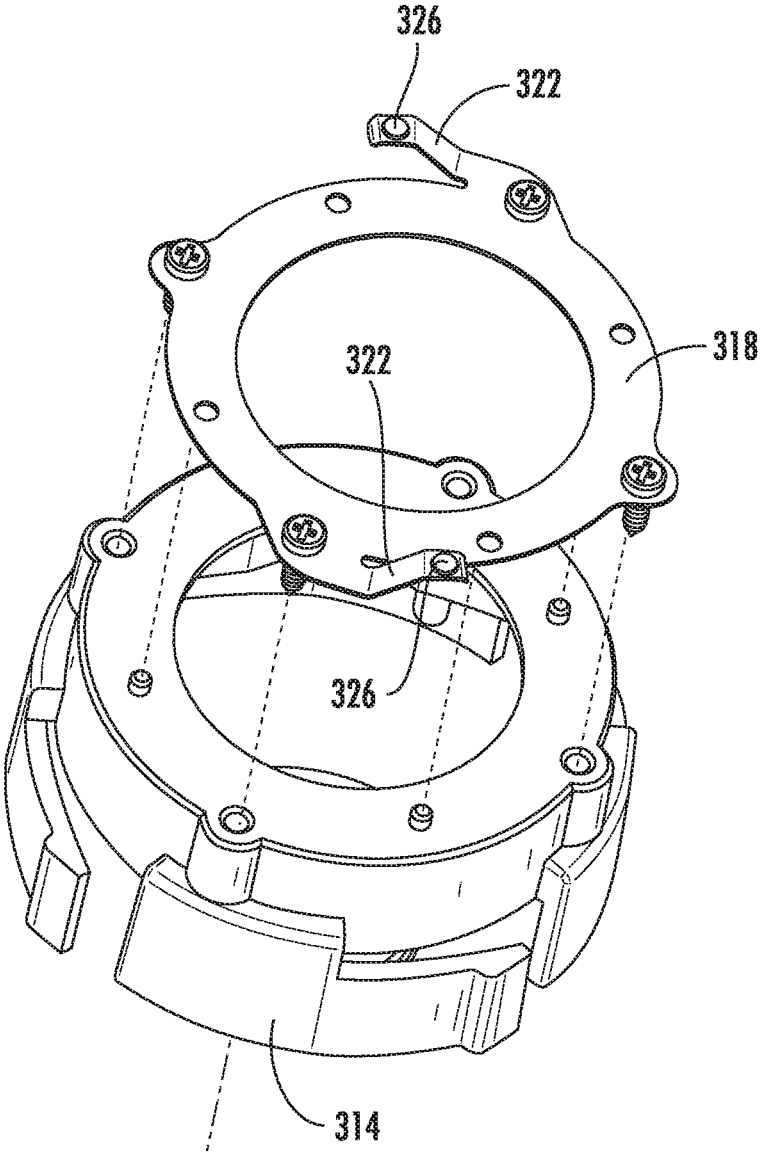
FIGS. 11 and 12 illustrate a rotor and associated contact used with the rotating handle of the anti-sweeping hook of FIG. 10.
Figure 12:
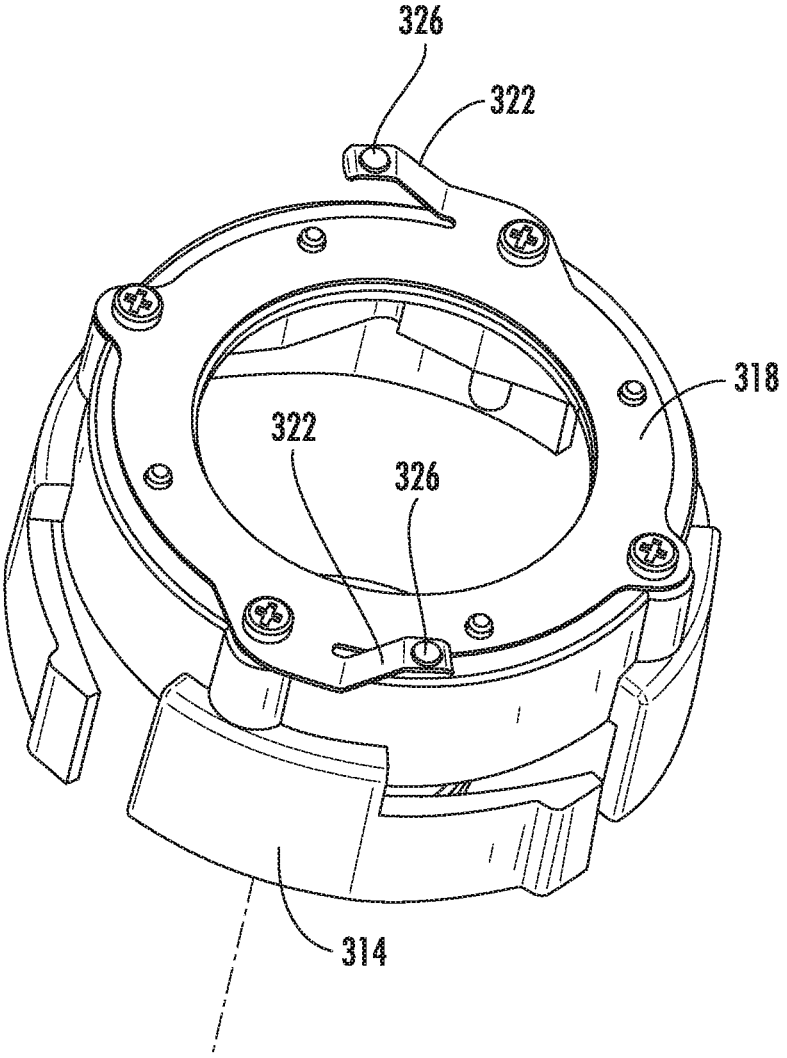
Figure 13:
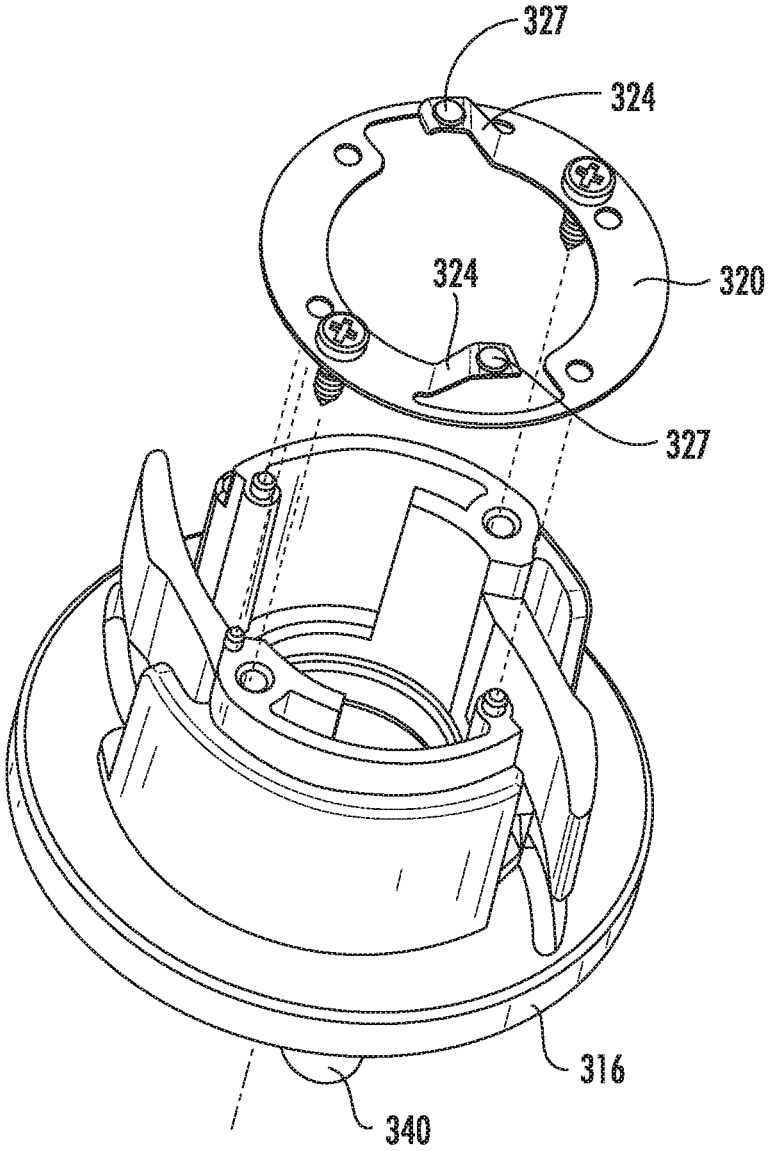
FIGS. 13 and 14 illustrate a stator and associated contact used with the rotating handle of the anti-sweeping hook of FIG. 10.
Figure 14:
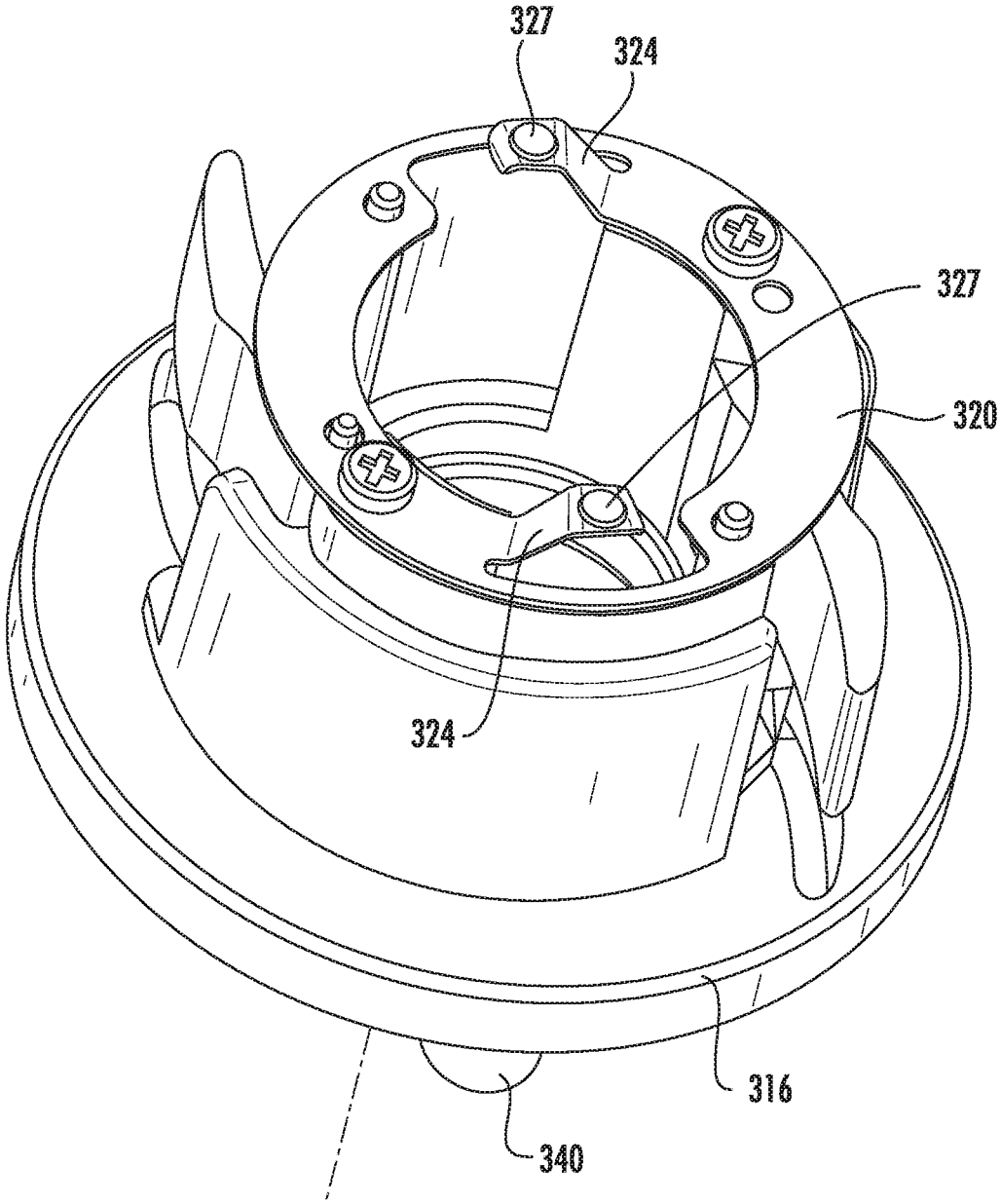
Figure 15:
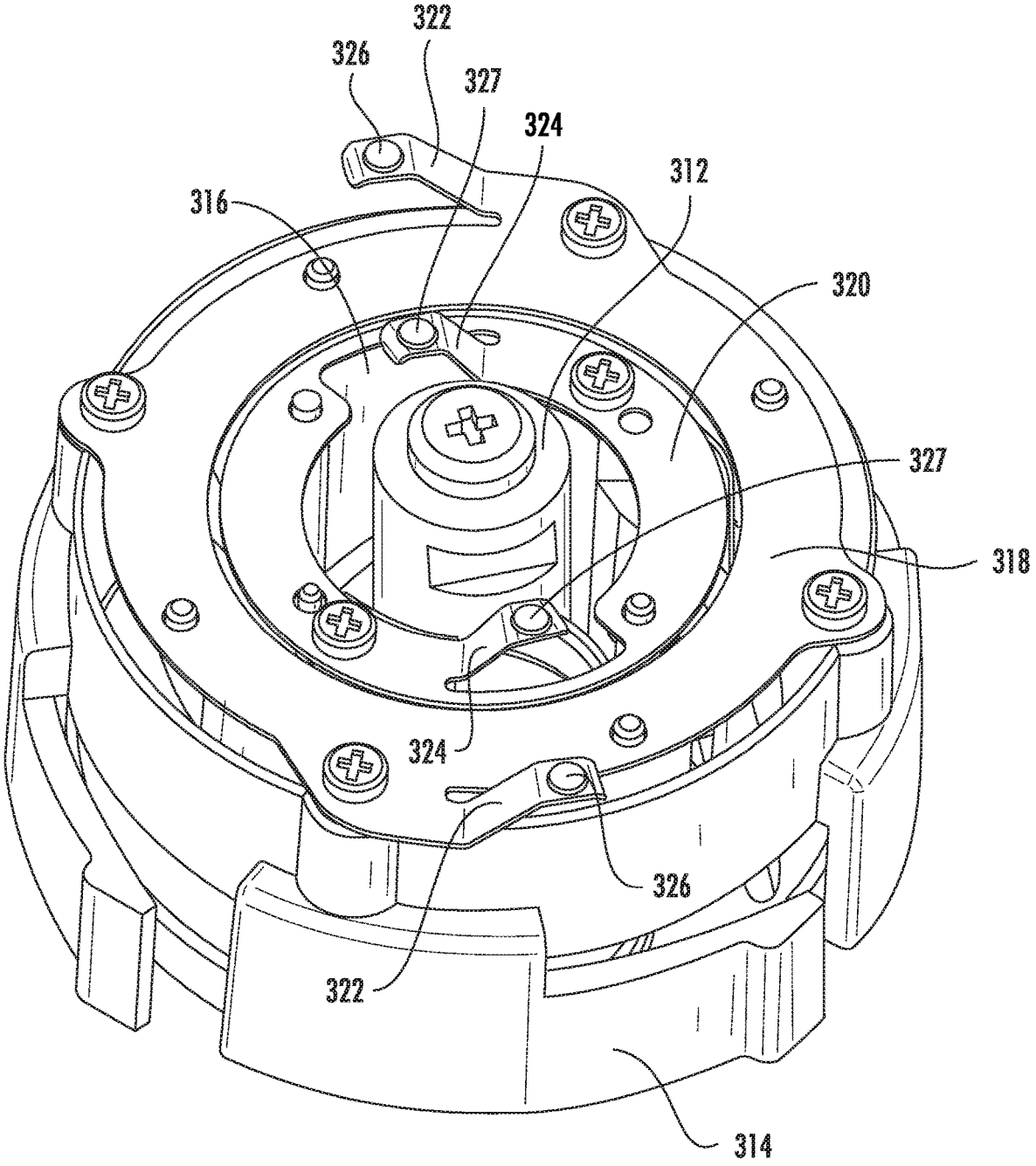
FIG. 15 illustrates the rotor and stator of FIGS. 11-14 assembled.
Figure 16:
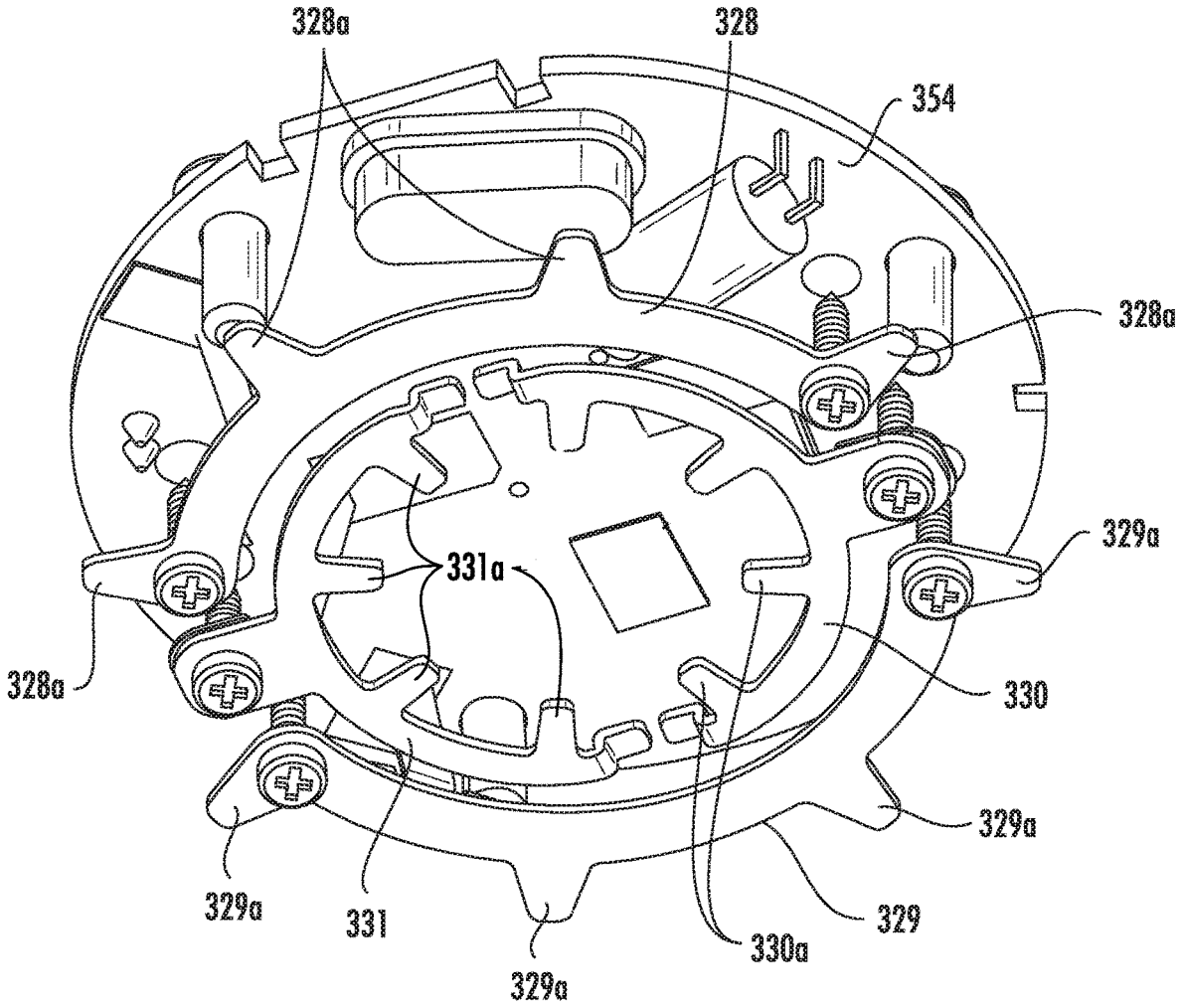
FIG. 16 illustrate contacts and the circuit board carried by a handle housing of the rotating handle of the anti-sweeping hook of FIG. 10.
Figure 17:
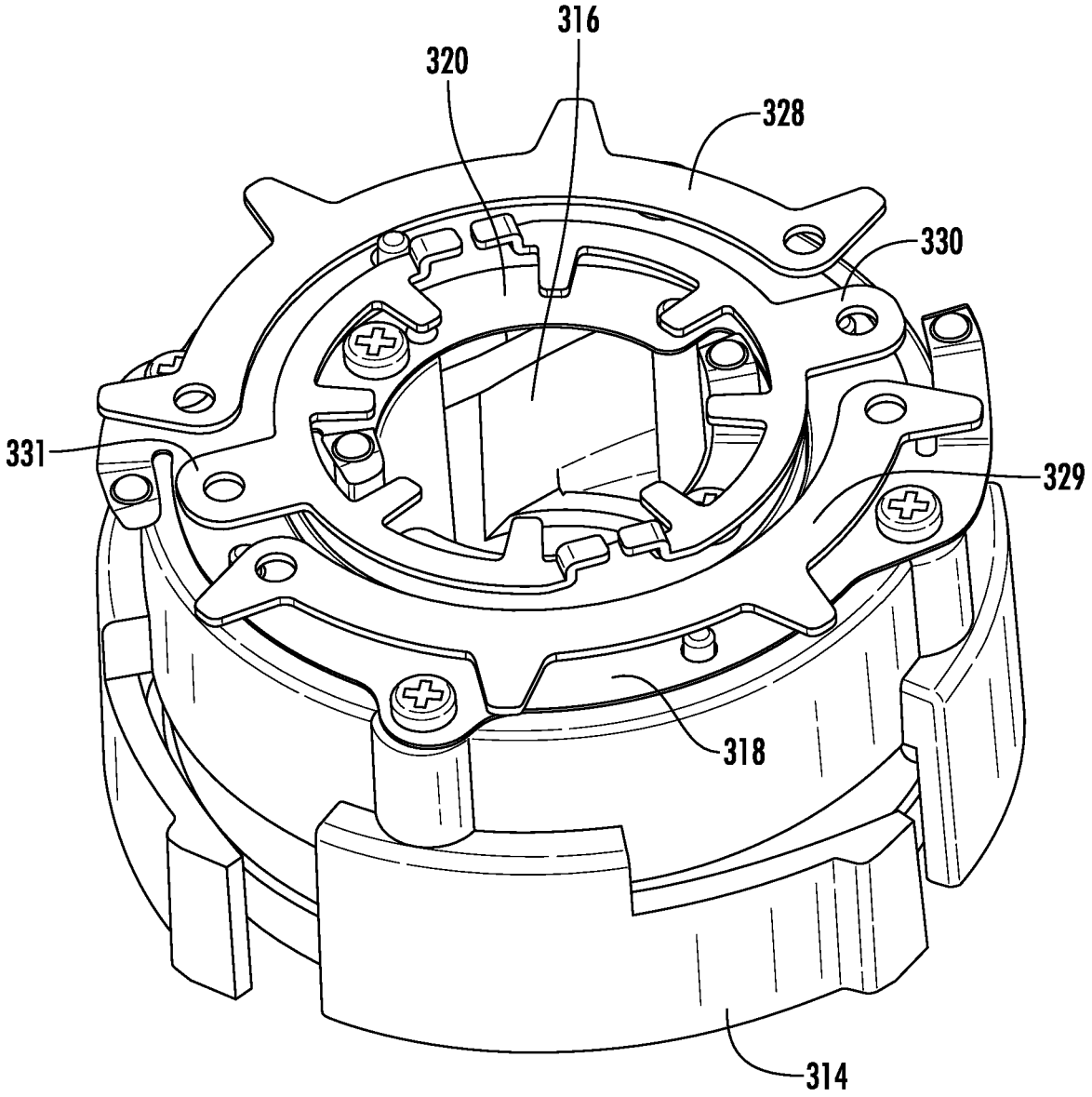
FIG. 17 illustrates the contacts of FIG. 16 relative to the rotor and stator and associated contacts illustrated in FIGS. 11-14.

Similar to the handle housing 110, handle housing 310 houses a rotor 314, which is shown in detail in FIGS. 11 and 12, and a stator 316, which is shown in more detail in FIGS. 13 and 14. The rotor 314 carries a first contact 318 while the stator 316 carries a second contact 320. When the rotor 314 is assembled around stator 316, as illustrated in FIG. 15, the first contact 318 is positioned radially outward from the second contact 320. The first and second contacts 318, 320 are ring like bodies, however, they need not be complete rings. The first contact 318 includes contact fingers 322 and the second contact includes contact fingers 324 each of which have upward-facing bumps 326, 327.

The handle housing 310 carries a first set of contacts 328, 329 and a second set of contacts 330, 331 that are in communication with a circuit board 354. The first set of contacts 328, 329 are part of a first circuit while the second set of contacts 330, 331 are part of a second circuit. Notably, contacts 328, 329 are isolated from one another and contacts 330, 331 are isolated from one another. When the handle housing 310 is rotated, contacts 328-331 rotate with the handle housing.

Each of the contacts 328, 329, 330, 331 have a plurality of radially extending contact lobes 328*a*, 329*a*, 330*a*, 331*a*. All of the lobes 328*a*, 329*a* of the first set of contacts 328, 329 are substantially equally angularly spaced apart while all of the lobes 330*a*, 331*a* of the second set of contacts 330, 331 are substantially equally angularly spaced apart. Further, the first set of contacts 328, 329 has a same number of lobes as the second set of contacts 330, 331.

In operation, the lobes 328*a*, 329*a* are radially spaced from the rotational axis of the handle 308 a same distance as upward facing bumps 326 of contact fingers 322 and the lobes 330*a*, 331*a* are radially spaced from the rotational axis of the handle 308 a same distance as upward facing bumps 327. As such, when the rotating handle housing 310 rotates relative to the stator 316 and/or rotor 314, the first and second contacts 318, 320 will selectively complete the first and second circuits.

In this example, the stator 316 is rotationally fixed to the housing 302. More particularly, stator 316 has nibs 340 (FIGS. 13 and 14) that extend into recesses 342 (FIG. 10) of the housing 302 to prevent relative rotation therebetween. The rotor 314 is permitted to rotate relative to stator 316 in only a single first direction.

The rotating handle housing 310 is configured to engage the rotor 314, similar to handle 108, such that when the rotating handle housing 310 rotates in the first direction, the rotating handle housing 310 engages rotor 314 and causes it to rotate in the first direction relative to stator 316. However, when the rotating handle housing 310 is rotated in an opposite second direction, the stator 316 engages the rotor 314 such that the rotor 314 will not rotate relative to the stator 316, but the rotating handle housing 310 will rotate relative to the stator 316 and 314, which are rotationally fixed to one another.

Thus, as the rotating handle housing 310 rotates in the first direction, the second contact 320 will selectively connect and disconnect inner contacts 330, 331 as the fingers 327 selective contact opposed ones of the lobes 330*a*, 331*a* that are 180 degrees apart from one another. This will selectively make and break the inner circuit that includes contacts 330, 331.

However, as noted above, when the rotating handle housing 310 is rotated in the first direction, the rotor 314 rotates with the rotating handle housing 310 relative to stator 316. Because the rotor 314 rotates with rotating handle housing 310, the rotor 314 does not change its angular position relative to rotating handle housing 310 or contacts 328, 329 carried thereby. As such, the outer circuit that includes contacts 328, 329 stays steady state of either constantly broken or constantly made. Therefore, when the rotating handle housing 310 is rotated in the first direction, the circuit board 354 will sense only changes in the inner circuit that includes contacts 330, 331.

When the rotating handle housing 310 is rotated in the second direction, rotor 314 is engaged by stator 316 such that rotor 314 remains angularly fixed relative to stator 316. Thus, the angular position of the rotating handle housing 310 now changes with respect to both the rotor 314 and the stator 316. As such, as the rotating handle housing 310 rotates, the inner contacts 330, 331 are repeatedly electrically connected and disconnected from one another by second contact 320 carried by the stator 316 like when rotation occurs in the first direction but now the outer contacts 328, 329 are repeatedly electrically connected and disconnected from one another by first contact 318 carried by the rotor 314. Thus, when the rotating handle housing 310 is rotated in the second direction, the circuit board 354 will sense changes in both the inner circuit that includes contacts 330, 331 as well as the outer circuit that includes contacts 328, 329.

Notably, when the legs 322, 324 are positioned angularly between adjacent, corresponding, lobes 328*a*, 329*a*, 330*a*, 331*a*, the corresponding circuits are broken and when the legs 322, 324 contact lobes 328*a*, 329*a*, 330*a*, 331*a*, the corresponding circuits are made.

Thus, the circuit board 354 can determine which direction the rotating handle housing 310 is being rotated by determining which circuits are being repeatedly connected and disconnected. Further, by counting the number of connections and disconnections, the degree of rotation of the coil 306 can be determined. As such, by being able to determine how much rotation as well as in which direction, the circuit board 354 can now determine if product is being loaded or unloaded onto the hook 304 as well as how much product is being loaded or unloaded onto the hook 304, e.g. a change in the amount of product on the hook 304.

Again, this information can also be used to determine if a theft or sweeping event is occurring by determining the rate at which the rotating handle housing 310 is rotated and the direction in which it is being rotated.

Figure 18:
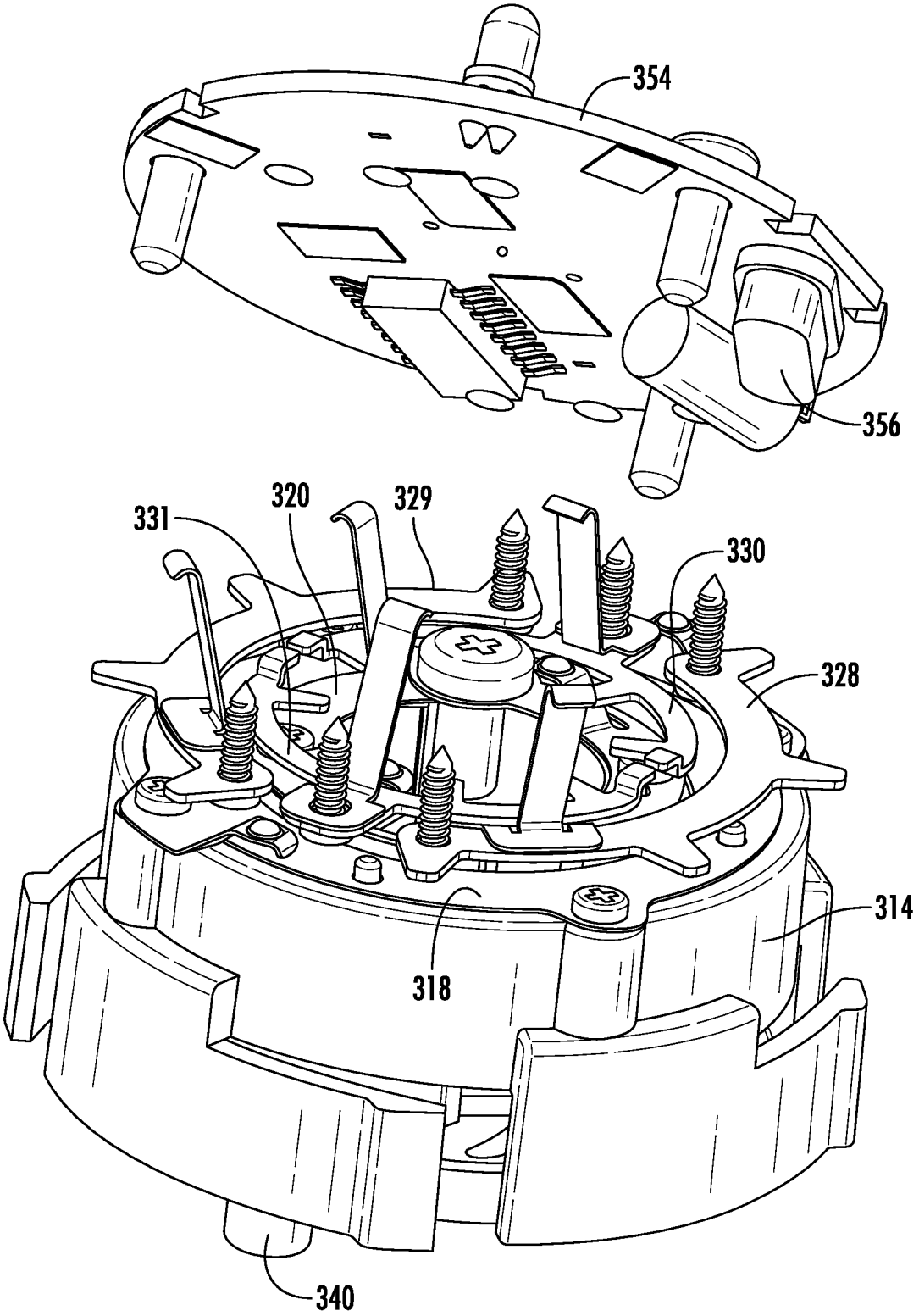
FIG. 18 illustrates the electronic components within the rotating handle of the anti-sweeping hook of FIG. 10.

With reference to FIG. 18, circuit board 354 includes a communication module 356 that communicates sensed data to the communication box. The communication module 356 may use wireless communication to communicate with alarm box 301 using any appropriate protocol, such as Wi-Fi, Bluetooth, sonar, etc. Alternatively, the hook 300 could use wired communication to communicate the information (sweeping, theft, product loading or product unloading) gathered by circuit board 354 to alarm box 301.

The same wakeup and sleep features as discussed above can be provided in hook 300.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An anti-sweeping hook comprising:

a display hook for storing retail merchandise, the display hook being substantially straight and having a first end and a second end opposite the first end;

a helical coil disposed about the display hook and extending along a lengthwise portion of the display hook, the helical coil having a first coil end proximate the first end of the display hook, wherein rotation of the helical coil in a first direction of the helical coil loads the retail merchandise onto the display hook, and rotation of the helical coil in a second direction of the helical coil opposite the first direction of the helical coil removes the retail merchandise from the display hook;

a rotating handle attached to the first coil end and adjacent to the first end of the display hook, wherein the rotating handle is configured to determine a change in an amount of stored inventory based on the amount and direction of rotation of the rotating handle;

wherein the rotating handle includes a first circuit and a second circuit; and a state change of the first circuit without a state change in the second circuit indicates rotation of the rotating handle in a first direction and a state change of both the first and second circuits indicates rotation of the rotating handle in a second direction, opposite the first direction.

2. The anti-sweeping hook of claim 1, wherein:

the rotating handle includes a rotor and stator each disposed within a main housing of the rotating handle, the rotor rotates relative to the stator with the main housing when the main housing rotates in a first direction of the main housing and the rotor remains fixed relative to the stator when the main housing is rotated in a second direction of the main housing;

the first circuit includes a first contact carried by the stator and a pair of contacts carried by the main housing;

the second circuit includes a second contact carried by the rotor and a pair of contacts carried by the main housing;

rotating the main housing in the first direction of the main housing causes the first contact to selectively connect and disconnect the pair of contacts of the first circuit carried by the main housing but does not cause the second contact to selectively connect and disconnect the pair of contacts of the second circuit carried by the main housing; and rotating the main housing in the second direction of the main housing causes the first contact to selectively connect and disconnect the pair of contacts of the first circuit carried by the main housing and does cause the second contact to selectively connect and disconnect the pair of contacts of the second circuit carried by the main housing.

3. The anti-sweeping hook of claim 2, wherein the stator is configured to prevent rotation of the rotor and of the second contact in the second direction of the helical coil, and configured to allow rotation of the rotor and of the second contact in the first direction of the helical coil.

4. The anti-sweeping hook of claim 2, wherein the rotating handle includes a circuit board with circuitry configured to count the electrical connections between the first contact and the pair of contacts carried by the rotating handle of the first circuit and to count the electrical connections between the second contact and the pair of contacts carried by the rotating handle of the second circuit.

5. The anti-sweeping hook of claim 4, wherein the rotating handle includes a wireless communications module configured to transmit inventory data related to the amount of product stored on the display hook to a local or remotely-located receiving device.

6. The anti-sweeping hook of claim 4, wherein the circuit board is configured to determine the amount of stored inventory based on a number of electrical connections made by the first and second circuits.

7. The anti-sweeping hook of claim 4, wherein the circuit board is configured to determine the change in the amount of stored inventory based on a number of electrical connections made by the first and second circuits.

8. The anti-sweeping hook of claim 2, wherein the stator is fixed relative to the display hook.

9. A method of determining a change in an amount of stored inventory on an anti-sweeping hook comprising:

rotating a rotating handle of the anti-sweeping hook, the anti-sweeping hook including:

a display hook configured for storing retail merchandise, the display hook having a first end and a second end opposite the first end;

a helical coil disposed about the display hook and extending along a lengthwise portion of the display hook, the helical coil having a first coil end proximate the first end of the display hook, wherein rotation of the helical coil in a first direction of the helical coil loads the retail merchandise onto the display hook, and rotation of the helical coil in a second direction of the helical coil opposite the first direction of the helical coil removes the retail merchandise from the display hook, the rotating handle being attached to the first coil end and adjacent to the first end of the display hook;

determining a change in the amount of stored inventory by determining the amount of rotation of the rotating handle and direction of rotation of the rotating handle;

wherein determining the direction of rotation of the rotating handle includes:

determining that the direction of rotation is in a first direction of a main housing when a state change of a first circuit of the rotating handle without sensing a state change of a second circuit is sensed; and determining that the direction of rotation is in a second direction, opposite the first direction of the main housing, when a state change of both the first and second circuits is sensed.

10. The method of claim 9, wherein:

the first circuit includes a first contact carried by a stator and a pair of contacts carried by the main housing;

the second circuit includes a second contact carried by a rotor and a pair of contacts carried by the main housing;

rotating the main housing of the rotating handle in a first direction of the main housing rotates the rotor of the rotating handle relative to the stator of the rotating handle, rotation of the main housing in the first direction of the main housing causes the first contact to selectively connect and disconnect the pair of contacts of the first circuit carried by the main housing but does not cause the second contact to selectively connect and disconnect the pair of contacts of the second circuit carried by the main housing;

when rotating the main housing of the rotating handle in a second direction of the main housing, the rotor remains fixed relative to the stator when the main housing is rotated in the second direction of the main housing, and rotation of the main housing in the second direction of the main housing causes the first contact to selectively connect and disconnect the pair of contacts of the first circuit carried by the main housing and does cause the second contact to selectively connect and disconnect the pair of contacts of the second circuit carried by the main housing.

11. The method of claim 10, comprising:

preventing, with the stator, rotation of the rotor and of the second contact in the second direction of the main housing, and allowing, with the stator, rotation of the rotor and of the second contact in the first direction of the main housing.

12. The method of claim 10, further comprising:

counting the electrical connections between the first contact and the pair of contacts carried by the rotating handle of the first circuit, and counting, via a circuit board, the electrical connections between the second contact and the pair of contacts carried by the rotating handle of the second circuit.

13. The method of claim 12, wherein the circuit board is configured to determine a change in the amount of stored inventory based on a number of electrical connections made by the first and second circuits.

14. The method of claim 13, wherein the circuit board is configured to determine an amount of stored inventory based on the change in the amount of stored inventory based on the number of electrical connections made by the first and second circuits.

15. The method of claim 10, wherein the stator is fixed relative to the display hook.

16. The method of claim 12, wherein:

counting the electrical connections between the first contact and the pair of contacts carried by the rotating handle of the first circuit is performed by the circuit board, and counting the electrical connections between the second contact and the pair of contacts carried by the rotating handle of the second circuit is performed by the circuit board.

* * * * *